US006314333B1

(12) United States Patent
Rajala et al.

(10) Patent No.: US 6,314,333 B1
(45) Date of Patent: Nov. 6, 2001

(54) METHOD AND APPARATUS FOR CONTROLLING WEB TENSION BY ACTIVELY CONTROLLING VELOCITY AND ACCELERATION OF A DANCER ROLL

(75) Inventors: Gregory John Rajala, Neenah; Robert Donald Lorenz, Madison, both of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/110,753

(22) Filed: Jul. 3, 1998

(51) Int. Cl.[7] ..... G06F 7/66

(52) U.S. Cl. ..... 700/122; 226/44; 318/6; 318/7

(58) Field of Search ..... 700/122; 226/44; 318/6, 7, 271; 364/469

(56) References Cited

U.S. PATENT DOCUMENTS

| | | | | |
|---|---|---|---|---|
| 3,659,767 | * | 5/1972 | Martin | 226/195 |
| 3,809,335 | | 5/1974 | Mantey | 242/186 |
| 3,936,008 | | 2/1976 | Crum | 242/75.44 |
| 4,000,865 | | 1/1977 | Gaskins | 242/75.43 |
| 4,081,301 | | 3/1978 | Buell | 156/164 |
| 4,103,840 | | 8/1978 | Dowd | 242/67.3 R |
| 4,151,594 | | 4/1979 | Stern | 364/400 |
| 4,229,243 | | 10/1980 | Ellinor | 156/269 |
| 4,239,578 | | 12/1980 | Gore | 156/361 |
| 4,261,782 | | 4/1981 | Teed | 156/361 |
| 4,293,367 | | 10/1981 | Klasek et al. | 156/494 |
| 4,309,236 | | 1/1982 | Teed | 156/164 |
| 4,405,397 | | 9/1983 | Teed | 156/164 |
| 4,458,467 | | 7/1984 | Shulman et al. | 53/399 |
| 4,464,217 | | 8/1984 | Dickover et al. | 156/164 |
| 4,479,836 | | 10/1984 | Dickover et al. | 156/164 |
| 4,572,098 | | 2/1986 | Chiu | 118/33 |
| 4,572,752 | | 2/1986 | Jensen et al. | 156/64 |
| 4,645,109 | | 2/1987 | Fleissner | 226/42 |
| 4,786,346 | | 11/1988 | Ales et al. | 156/160 |
| 4,801,345 | | 1/1989 | Dussaud et al. | 156/164 |
| 4,838,969 | | 6/1989 | Nomura et al. | 156/160 |
| 4,854,989 | | 8/1989 | Singheimer | 156/161 |
| 4,889,293 | | 12/1989 | Duke et al. | 242/75.51 |
| 4,915,282 | | 4/1990 | Martin et al. | 226/119 |
| 4,915,767 | | 4/1990 | Rajala et al. | 156/440 |
| 4,917,746 | | 4/1990 | Kons et al. | 156/164 |
| 4,941,939 | | 7/1990 | Nomura et al. | 156/495 |
| 4,946,539 | | 8/1990 | Ales et al. | 156/495 |
| 5,080,741 | | 1/1992 | Nomura et al. | 156/201 |

(List continued on next page.)

FOREIGN PATENT DOCUMENTS

| | | | |
|---|---|---|---|
| 0476818 A1 | 3/1992 | (EP) | D05B/35/06 |
| 2241424 A | 9/1991 | (GB) | A41H/43/00 |
| 2248380 B | 4/1992 | (GB) | A61F/13/15 |
| 4028363 | 1/1992 | (JP) | A61F/13/54 |

*Primary Examiner*—Ayaz Sheikh
*Assistant Examiner*—Firmin Backer

(57) ABSTRACT

This invention pertains to processing continuous webs such as paper, film, composites, and the like, in dynamic continuous processing operations. More particularly, it relates to controlling tension in such continuous webs during the processing operation. Tension is controlled in a dancer control system by connecting a corresponding dancer roll to an actuator apparatus or the like, sensing variables such as position, tension, velocity, and acceleration parameters related to the web and the dancer roll, and providing active force commands, in response to the sensed variables, to cause translational movement, generally including a target acceleration, in the dancer roll to control tension disturbances in the web. In some applications of the invention, the dancer control system is used to attenuate tension disturbances. In other applications of the invention, the dancer control system is used to create tension disturbances.

85 Claims, 26 Drawing Sheets

U.S. PATENT DOCUMENTS

| | | | | |
|---|---|---|---|---|
| 5,086,964 | | 2/1992 | Blaser | 226/108 |
| 5,091,039 | | 2/1992 | Ujimoto et al. | 156/519 |
| 5,147,487 | | 9/1992 | Nomura et al. | 156/164 |
| 5,178,341 | * | 1/1993 | Ditto | 242/412.2 |
| 5,213,645 | | 5/1993 | Nomura et al. | 156/164 |
| 5,221,390 | | 6/1993 | Persson et al. | 156/164 |
| 5,236,539 | | 8/1993 | Rogberg et al. | 156/495 |
| 5,275,676 | | 1/1994 | Rooyakkers et al. | 156/164 |
| 5,357,178 | | 10/1994 | Kapitan | 318/7 |
| 5,366,130 | | 11/1994 | Fukuda | 226/44 |
| 5,485,386 | | 1/1996 | Andreasson | 364/471 |
| 5,517,914 | | 5/1996 | Tilton, Sr. | 101/226 |
| 5,602,747 | * | 2/1997 | Rajala | 364/469.01 |
| 5,647,276 | | 7/1997 | Tilton, Sr. | 101/219 |
| 5,659,229 | * | 8/1997 | Rajala | 318/6 |
| 5,679,195 | * | 10/1997 | O'Dwyer et al. | 156/159 |
| 5,806,783 | * | 9/1998 | Turunen | 242/530.1 |

* cited by examiner

CONTROL BLOCK DIAGRAM
(5TH EMBODIMENT)

$F^*_{FRICTION}$
$F^*_{dSTATIC}$
$F^*_c$
$dF^*_c/dt$
$A^*_p$
Sign($V_p$)
$K_a$
$K_2$
$M_a$
ZOH
$\frac{1}{M_2}$
$A_p$
$V_p$
$\Delta P$
$\frac{EA_o}{P}$
$F_c$
COMPUTE ACCELERATION
COMPUTE VELOCITY
COMPUTE TENSION DERIVATIVE
CONTROL SYSTEM

CONTROL BLOCK DIAGRAM
(7TH EMBODIMENT)

$F_c$
$\frac{EA_o}{P}$
$\Delta P$
$V_p$
$A_p$
$\frac{1}{M_2}$
ZOH
Sign($V_p$)
$K_a$
$K_2$
M
COMPUTE ACCELERATION AND VELOCITY
COMPUTE TENSION DERIVATIVE
CONTROL SYSTEM
$F^*_{FRICTION}$
$F^*_{dSTATIC}$
$F^*_c$
$dF^*_{ce}/dt$
$A^*_p$

CONTROL BLOCK DIAGRAM
(9TH EMBODIMENT)

$F^*_{FRICTION}$
$F^*_{dSTATIC}$
$F^*_c$
$V^*_p$
$A^*_p$
Sign($V_p$)
$K_a$
$b_a$
$M_a$
ZOH
$\frac{1}{M_2}$
$A_p$
$V_p$
$\Delta P$
$\frac{EA_o}{P}$
$F_c$
COMPUTE ACCELERATION
COMPUTE VELOCITY
CONTROL SYSTEM

METHOD AND APPARATUS FOR CONTROLLING WEB TENSION BY ACTIVELY CONTROLLING VELOCITY AND ACCELERATION OF A DANCER ROLL

CROSS REFERENCE TO RELATED APPLICATIONS

Not Applicable

STATEMENT REGARDING FEDERALLY SPONSORED RESEARCH OR DEVELOPMENT

Not Applicable

FIELD OF THE INVENTION

This invention relates to the processing of continuous webs such as paper, film, composites, or the like, in dynamic continuous processing operations. More particularly, the invention relates to controlling tension in such continuous webs during the processing operation.

BACKGROUND OF THE INVENTION

In the paper and plastic film industries, a dancer roll is widely used as a buffer between first and second sets of driving rolls, or first and second nips, which drive a continuous web. The dancer roll, which is positioned between the two sets of driving rolls, is also used to detect the difference in speed between the first and second sets of driving rolls.

Typically, the basic purpose of a dancer roll is to maintain constant the tension on the continuous web which traverses the span between the first and second sets of driving rolls, including traversing the dancer roll.

As the web traverses the span, passing over the dancer roll, the dancer roll moves up and down in a track, serving two functions related to stabilizing the tension in the web. First, the dancer roll provides a tensioning force to the web. Second, the dancer roll temporarily absorbs the difference in drive speeds between the first and second sets of driving rolls, until such time as the drive speeds can be appropriately coordinated.

A web extending between two drive rolls constitutes a web span. The first driving roll moves web mass into the span, and the second driving roll moves web mass out of the span. The quantity of web mass entering a span, per unit time, equals the web's cross-sectional area before it entered the span, times its velocity at the first driving roll. The quantity of web mass exiting a span, per unit time, equals the web's cross-sectional area in the span, times its velocity at the second driving roll. Mass conservation requires that over time, the web mass exiting the span must equal the mass entering the span. Web strain, which is proportional to tension, alters a web's cross-sectional area. Typically, the dancer roll is suspended on a support system, wherein a generally static force supplied by the support system supports the dancer roll against an opposing force applied by the tension in the web and the weight of the dancer roll. The web tensioning force, created by the dancer system, causes a particular level of strain which produces a particular cross-sectional area in the web. Therefore, the web mass flowing out of the span is established by the second driving roll's velocity and the web tensioning force because the web tensioning force establishes web strain which in turn establishes the web's cross-sectional area. If the mass of web exiting the span is different from the mass of web entering the span, the dancer roll moves to compensate the mass flow imbalance.

A dancer roll generally operates in the center of its range of travel. A position detector connected to the dancer roll recognizes any changes in dancer roll position, which signals a control system to either speed up or slow down the first driving roll to bring the dancer back to the center of its travel range and reestablish the mass flow balance.

When the dancer roll is stationary, the dancer support system force, the weight of the dancer roll, and the web tension forces are in static equilibrium, and the web tension forces are at their steady state values. Whenever the dancer moves, the web tension forces change from their steady state values. This change in web tension force supplies the effort that overcomes friction, viscous drag, and inertia, and causes the dancer motion. When the dancer moves very slowly, viscous drag and inertia forces are low and therefore the change in web tension is slight. However, during abrupt changes in mass flow, as during a machine speed ramp-up or ramp-down, the viscous drag, and inertia forces may be several times the web's steady state tension values.

The dancer roll's advantages are that it provides a web storage buffer that allows time to coordinate the speed of machine drives, and the dancer provides a relatively constant web tension force during steady state operation, or periods of gradual change. A limitation of dancer rolls, as conventionally used, is that under more dynamic circumstances, the dancer's ability to maintain constant web tension depends upon the dancer system's mass, drag, and friction.

It is known to provide an active drive to the dancer roll in order to improve performance over that of a static system, wherein the web is held under tension, but is not moving along the length of the web, whereby the dynamic, disturbances, and the natural resonance frequencies of the dancer roll and the web are not accounted for, and whereby the resulting oscillations of the dancer roll can become unstable. Kuribayashi et al, "An Active Dancer Roller System for Tension Control of Wire and Sheet." University of Osaka Prefecture, Osaka, Japan, 1984.

More information about tension disturbances and response times is set forth in U.S. Pat. No. 5,659,229 issued Aug. 19, 1997, which is hereby incorporated by reference in its entirety. U.S. Pat. No. 5,659,229, however, controls the velocity of the dancer roll and does not directly control the acceleration of the dancer roll.

Thus, it is not known to provide an active dancer roll in a dynamic system wherein dynamic variations in operating parameters are used to calculate variable active response force components for applying active and variable acceleration to the dancer roll, and wherein appropriate gain constants are used to affect response time without allowing the system to become unstable.

SUMMARY OF THE DISCLOSURE

This invention describes apparatus and methods for controlling tension and tension disturbances in a continuous web during processing of the web. In a first aspect, the invention can be used to attenuate undesired tension disturbances in the web. In a second aspect, the invention can be used to create desired tension disturbances in the web.

In a typical converting process, a parent roll of paper, composite, or like web of raw material is unwound at one end of a processing line, and is processed through the processing line to thereby convert the raw material, such as to shorter or narrower rolls of product; or to shape products from the raw material, to separate products from the raw material, and/or to combine the raw material with other input elements to thereby create a product or product pre-cursor.

Such processing operations are generally considered "continuous" processes because the roll of raw material generally runs "continuously" for an extended period of time, feeding raw material to the processing system.

A first family of embodiments of the invention is illustrated in a processing apparatus for advancing a continuous web of material through a processing step wherein the web experiences an average dynamic tension along a given section of the web, the processing apparatus comprising a dancer roll operative for controlling tension on the respective section of web; an actuator apparatus (i) for applying a first static force component, to the dancer roll, having a first value and direction, and balancing the dancer roll against static forces and the average dynamic tension in the respective section of the web, and a controller connected to the actuator apparatus, the controller outputting a second variable force component, through the actuator apparatus, effective to control the net actuating force imparted to the dancer roll by the actuator apparatus, and to periodically adjust the value and direction of the second variable force component, each such value and direction of the second variable force component replacing the previous such value and direction of the second variable force component, and acting in combination with the first static force component to impart a target net translational acceleration to the dancer roll, the second variable force component having a second value and direction, modifying the first static force component, such that the net translational acceleration of the dancer roll is controlled by the net actuating force enabling the dancer roll to control the web tension.

In some embodiments of the invention, the processing apparatus includes a sensor for sensing tension in the web after the dancer roll, the controller being adapted to use the sensed tension in computing the value and direction of the second variable force component, and for imparting the computed value and direction through the actuator apparatus to the dancer roll. The sensor can be effective to sense tension at least 1 time per second, and effective to recompute the value and direction of the second variable force component, thereby to adjust the value and direction of the computed second variable force component at least 1 time per second.

In other embodiments, the sensor can be effective to sense tension at least 500 times per second, the controller being effective to recompute the value and direction of the second variable force component, thereby to adjust the value and direction of the computed second variable force component at least 500 times per second, the actuator apparatus being effective to apply the recomputed second variable force component to the dancer roll at least 500 times per second according to the values and directions computed by the controller, thus to control the net translational acceleration.

In some embodiments, the sensor can be effective to sense tension at least 1000 times per second, the controller comprising a computer controller effective to recompute the value and direction of the second variable force component and thereby to adjust the value and direction of the computed second variable force component at least 1000 times per second, the actuator apparatus being effective to apply the recomputed second variable force component to the dancer roll at least 1000 times per second according to the values and directions computed by the computer controller, thus to control the net translational acceleration.

In some embodiments, the controller controls the actuating force imparted to the dancer roll, and thus acceleration of the dancer roll, including compensating for any inertia imbalance of the dancer roll not compensated for by the first static force component.

In some embodiments, the processing apparatus includes an apparatus for computing the translational acceleration ($A_p$) of the dancer roll, the controller providing control commands to the actuator apparatus based on the computed acceleration of the dancer roll. The apparatus can comprise an observer.

In some embodiments, the observer comprises a subroutine in a computer program that computes an estimated translational acceleration and an estimated translational velocity for the dancer roll. In other embodiments, the observer comprises an electrical circuit.

In another embodiment of the invention, the processing apparatus includes: first apparatus for measuring a first velocity of the web after the dancer roll; second apparatus for measuring a second velocity of the web at the dancer roll; third apparatus for measuring translational velocity of the dancer roll; and fourth apparatus for sensing the position of the dancer roll.

In another embodiment of the invention, the processing apparatus further includes: fifth apparatus for measuring web tension before the dancer roll: and sixth apparatus for measuring web tension after the dancer roll. In such embodiments, the computer controller can compute a force command using the equation:

$$F^*_{servo}=F^*_{d\ static}+F^*_{friction}\mathrm{Sign}(V_p)+b_a(V^*_p-V_p)+k_a(F^*_c-F_c)+M_a(A^*_p-A_p)$$

wherein the dancer translational velocity set-point $V^*_p$ reflects the equation:

$$V^*_p=[EA_o/(EA_o-F_c)][V_2(1-F_b/EA_o)-V_3(1-F_c/EA_o)],$$

to control the actuator apparatus based on the force so calculated, wherein:

$F^*_{d\ static}$=static force component on the dancer roll and is equal to $Mg+2F^*_c$, $F_c$=tension in the web after the dancer roll, $F^*_c$=tension in the web, target set point, per process design parameters, $F_b$=tension in the web ahead of the dancer roll, $F^*_{friction}$=Friction in either direction resisting movement of the dancer roll, $F^*_{servo}$=Force to be applied by the actuator apparatus, $b_a$=control gain constant regarding dancer translational velocity, in Newton seconds/meter, $k_a$=control gain constant regarding web tension, Mg=mass of the dancer roll times gravity, $M_A$=active mass, $M_e$=active mass and physical mass, $V_p$=instantaneous translational velocity of the dancer roll immediately prior to application of the second variable force component, Sign($V_p$)–positive or negative value depending on the direction of movement of the dancer roll, $V_2$=velocity of the web at the dancer roll, $V_3$=velocity of the web after the dancer roll, $V^*_p$=reference translational velocity of the dancer roll, set point, r=radius of a respective pulley on the actuator apparatus, E=Modulus of elasticity of the web, $A_o$=cross-sectional area of the unstrained web, $A^*_p$=target translational acceleration of the dancer roll, set point, and $A_p$=translational acceleration of the dancer roll.

In some embodiments, the target acceleration $A^*_p$ can be computed using the equation:

$$A^*_p=[V^*_p-V_p]/\Delta T$$

where ΔT=scan time for the computer controller.

In some embodiments, the computer controller provides control commands to the actuator apparatus based on the sensed position of the dancer roll, and the measured web tensions, acceleration and velocities, and thereby controlling the actuating force imparted to the dancer roll by the actuator apparatus to thus maintain a substantially constant web tension.

In some embodiments, the computer controller provides control commands to the actuator apparatus based on the sensed position of the dancer roll, and the measured web tensions, acceleration and velocities, and thereby controlling the actuating force imparted to the dancer roll by the actuator apparatus to provide a predetermined pattern of variations in the web tension.

In another embodiment of the invention, the processing apparatus includes: first apparatus for measuring translational velocity of the dancer roll; second apparatus for measuring web tension force after the dancer roll; and third apparatus for sensing the current of the actuator apparatus.

In some embodiments, the controller computes a derivative of web tension force from the web tension force over the past sensing intervals, and includes an observer computing the translational velocity of the dancer roll, and the controller computing a derivative of the web tension force.

In some embodiments, the processing apparatus includes an observer for computing a derivative of web tension force from the web tension force and the translational velocity of the dancer roll.

In some embodiments, the controller comprises a fuzzy logic subroutine stored in the computer controller, the fuzzy logic subroutine inputting web tension force error, the derivative of web tension force error, and acceleration error, the fuzzy logic subroutine proceeding through the step of fuzzy inferencing of the above errors, applying if-then rules to the fuzzy sets, and de-fuzzifying of the rules' outcomes to generate a command output signal, the fuzzy logic subroutine being executed during each scan of the sensing apparatus.

In another embodiment of the invention, the processing apparatus includes: first apparatus for measuring translational velocity of the dancer roll: and second apparatus for sensing the current of the actuator apparatus. In such an embodiment, the computer controller can compute the estimated translational acceleration of the dancer roll from the equation:

$$A_{pe}=[k_1(V_p-V_{pe})+k_{te}I-F^*_{d\ static}-F^*_{friction}\mathrm{Sign}(V_p)]/M_{2e}$$

where:

$A_{pe}$=estimated translational acceleration of the dancer roll, $F^*_{d\ static}$=static force component on the dancer roll and is equal to $Mg+2F^*_c$, $F^*_{friction}$=Friction in either direction resisting movement of the dancer roll, $\mathrm{Sign}(V_p)$=positive or negative value depending on the direction of movement of the dancer roll, $k_1$=Observer gain, $V_p$=instantaneous translational velocity of the dancer roll, $V_{pe}$=estimated translational velocity, $k_{te}$=Servo motor (actuator apparatus) torque constant estimate, I=actuator apparatus current, and $M_{2e}$=Estimated physical mass of the dancer roll.

In some embodiments, a zero order hold can be utilized to store force values for application to the dancer roll.

In some embodiments, the processing apparatus actively compensates for coulomb and viscous friction, and acceleration, to actively cancel the effects of mass.

In another embodiment of the invention, the processing apparatus includes: first apparatus for measuring translational position of the dancer roll; second apparatus for measuring web tension force after the dancer roll; and third apparatus for sensing the motor current of the actuator apparatus.

In some embodiments, the controller computes a derivative of web tension from the present measured web tension and the web tension measured in the previous sensing interval.

In some embodiments, the processing apparatus includes an observer for computing estimated translational velocity and estimated translational acceleration of the dancer roll from the change in position of the dancer roll.

In another embodiment of the invention, the processing apparatus includes: first apparatus for measuring translational position of the dancer roll; and second apparatus for sensing the motor current of the actuator apparatus.

In some embodiments, the controller computes an estimated dancer translational velocity by subtracting the present value for translational position from the previous value for translational position and then dividing by the time interval between sensing of the values.

In some embodiments, the processing apparatus includes an observer for computing dancer roll translational acceleration.

In some embodiments, the processing apparatus computes a new force command for the actuator apparatus in response to the earlier computed values.

In another embodiment of the invention, the processing apparatus includes: first apparatus for measuring web tension FC after the dancer roll; and second apparatus for sensing the motor current of the actuator apparatus.

In some embodiments, the processing apparatus includes an observer utilizing the motor current and force on the web, in combination with an estimate of system mass $M_{2e}$, to compute an estimated translational velocity and a derivative of web tension.

In some embodiments, the processing apparatus includes an observer utilizing the motor current and force on the web, in combination with an estimate of system mass $M_{2e}$, to compute an estimate of translational acceleration $A_{pe}$.

In some embodiments, an observer integrates the translational acceleration to compute an estimate of translational velocity $V_{pe}$ and integrates the estimated translational velocity to compute an estimated web tension force $F_{ce}$.

In operation, an observer generally changes values until the estimated web tension force equals the actual web tension force.

In another family of embodiments, the processing apparatus for advancing a continuous web of material through a processing step comprises: a dancer roll operative for controlling tension on the respective section of web: an actuator apparatus connected to the dancer roll and thereby providing an actuating force to the dancer roll; first apparatus for measuring a first velocity of the web after the dancer roll;

second apparatus for measuring a second velocity of the web at the dancer roll: third apparatus for measuring motor current of the actuator apparatus; fourth apparatus for measuring web tension before the dancer roll; fifth apparatus for measuring web tension after the dancer roll: and a controller for providing force control commands to the actuator apparatus based on the above measured values, and at least on the computed acceleration $A^*_p$ of the dancer roll, the controller thereby controlling the actuating force imparted to the dancer roll by the actuator apparatus to control the web tension.

In such a family of embodiments, the processing apparatus can include: sixth apparatus for measuring translational velocity of the dancer roll: seventh apparatus for sensing the position of the dancer roll; and eighth apparatus for measuring acceleration of the dancer roll.

In some embodiments, the controller can be effective to provide control commands to the actuator apparatus at a frequency of at least 1 time per second.

In some embodiments, the controller can be effective to provide control commands to the actuator apparatus at a frequency of at least 500 times per second.

In some embodiments, the controller can comprise a computer controller effective to provide control commands to the actuator apparatus at a frequency of at least 1000 times per second.

In some embodiments, the controller provides the control commands to the actuator apparatus thereby controlling the actuating force imparted to the dancer roll by the actuator apparatus, and thus controlling acceleration of the dancer roll, such that the actuator apparatus maintains inertial compensation for the dancer system.

In some embodiments, the processing apparatus includes an unwind roll upstream from the dancer roll, the controller sending control signals to the unwind roll and the driving rolls.

In some embodiments, the eighth apparatus comprises an accelerometer secured to a drive element driving the dancer roll, to thereby move translationally with the dancer roll to measure acceleration thereof.

In some embodiments, the computer controller intentionally periodically varies the force component to unbalance the system, and thus the tension on the web by periodically inputting a command force from the actuator apparatus causing a sudden, temporary upward movement of the dancer roll, followed by a corresponding downward movement such that the dancer roll intermittently imposes alternating higher and lower levels of tension on the web. The periodic input of force can cause the upward movement of the dancer roll to be repeated more than 200 times per minute.

In another family of embodiments, the invention is illustrated in a method of controlling the tension in the respective section of web, comprising: providing a dancer roll operative on the respective section of web: applying a first generally static force component to the dancer roll, through the first generally static force component having a first value and direction: applying a second variable force component to the dancer roll, the second variable force component having a second value and direction, modifying the first generally static force component, and thereby modifying (i) the effect of the first generally static force component on the dancer roll and (ii) corresponding translational acceleration of the dancer roll; and adjusting the value and direction of the second variable force component repeatedly, each such adjusted value and direction of the second variable force component (i) replacing the previous such value and di recti on of the second variable force component and (ii) acting in combination with the first static force component to provide a target net translational acceleration to the dancer roll.

In some embodiments, the method includes adjusting the value and direction of the second variable force component at least 500 times per second.

In some embodiments, the method includes sensing tension in the web after the dancer roll, and using the sensed tension to compute the value and direction of the second variable force component.

In some embodiments, the method includes sensing tension in the respective section of the web at least 1 time per second, recomputing the value and direction of the second variable force component and thereby adjusting the value and direction of the computed second variable force component at least 1 time per second, and applying the recomputed value and direction to the dancer roll at least 1 time per second.

In many embodiments, the first and second force components are applied simultaneously to the dancer roll as a single force, by an actuator apparatus.

In some embodiments, the force components and target net translational acceleration are adjusted such that the tension in the web maintains an average dynamic tension throughout the processing operation while controlling translational acceleration such that system effective mass equals the dancer roll's polar inertia divided by the roll's outer radius squared.

In some embodiments, the force components and target net translational acceleration are periodically adjusted to intentionally unbalance the dancer roll such that the tension in the dancer roll moves through a sudden, temporary upward movement, followed by a corresponding downward movement, to intermittently impose alternating higher and lower levels of tension on the web. In such an embodiment, the periodic input of force can cause the upward movement of the dancer roll to be repeated more than 200 times per minute.

In some embodiments, the method, wherein the first and second force components are applied simultaneously to the dancer roll as a single force by an actuator apparatus, includes: measuring a first velocity of the web after the dancer roll: measuring a second velocity of the web at the dancer roll; measuring translational velocity of the dancer roll; and sensing the position of the dancer roll.

In some embodiments, the method further includes measuring web tension before the dancer roll and measuring web tension before and after the dancer roll.

In some embodiments, the method includes measuring translational velocity of the dancer roll, measuring web tension force after the dancer roll, and sensing the current of the actuator apparatus, the measuring and sensing occurring during periodic sensing intervals.

In some embodiments, the method includes, computing a derivative of web tension force from the web tension force from past and present sensing intervals, computing the translational velocity of the dancer roll, and computing a derivative of the web tension force.

In some embodiments, the method includes executing a fuzzy logic subroutine by inputting web tension force error, the derivative of web tension force error, and acceleration error, the fuzzy logic subroutine proceeding through the step of fuzzy inferencing of the above errors, applying if-then rules to the fuzzy sets, and de-fuzzifying of the rules' outcomes to generate a command output signal, the fuzzy logic subroutine being executed during each of the measuring and sensing intervals.

In some embodiments, the method includes: measuring the translational velocity of the dancer roll: and sensing the current of an actuator apparatus.

In some embodiments, the method includes the steps of: measuring the translational position of the dancer roll; measuring web tension force after the dancer roll; and sensing the motor current of an actuator apparatus applying the force to the dancer roll, the above measuring and sensing occurring at each sensing interval.

In some embodiments, the method includes computing a derivative of web tension from the present measured web tension and the web tension measured in the previous sensing interval.

In some embodiments, the method includes computing estimated translational velocity and estimated translational acceleration of dancer roll from the change in position of the dancer roll.

In some embodiments, the method includes: measuring the translational position of the dancer roll; and sensing the motor current of an actuator apparatus applying the force to the dancer roll.

In some embodiments, the method includes computing an estimated dancer translational velocity by subtracting the previous sensed value for translational position from the present sensed value of translational position and then dividing by the time interval between sensing of the values.

In some embodiments, the method includes measuring web tension $F_c$ after the dancer roll and sensing motor current of an actuator apparatus.

In some embodiments, the method includes utilizing the motor current and force on the web, in combination with an estimate of system mass $M_{2e}$, to compute an estimated translational velocity and a derivative of web tension.

In some embodiments, the method includes utilizing the motor current and force on the web, in combination with an estimate of system mass $M_{2e}$, to compute an estimate of translational acceleration $A_{pe}$.

In some embodiments, the method includes integrating the translational acceleration to compute an estimate of translational velocity $V_{pe}$ and integrating the estimated translational velocity to compute an estimated web tension force $F_{ce}$.

In another family of embodiments, the invention is illustrated in a processing operation wherein a continuous web of material is advanced through a processing step, a method of controlling the tension in the respective section of web. comprising: providing a dancer roll operative for controlling tension on the respective section of web; providing an actuator apparatus to apply an actuating force to the dancer roll: measuring a first velocity of the web after the dancer roll; measuring a second velocity of the web at the dancer roll; measuring motor current of the actuator apparatus; measuring web tension before the dancer roll: measuring web tension after the dancer roll; and providing force control commands to the actuator apparatus based on the above measured values, and at least on the computed acceleration $A^*_p$ of the dancer roll, to thereby control the actuating force imparted to the dancer roll by the actuator apparatus to control the web tension.

In some embodiments, the method includes measuring translational velocity of the dancer roll, sensing the position of the dancer roll, and measuring acceleration of the dancer roll.

In some embodiments, the method includes the steps of sending control signals to a wind-up roll downstream from the dancer roll and driving rolls upstream from the dancer roll.

In some embodiments, the method includes computing a target velocity command $V^*_p$ using the first and second sensed velocities and the web tension after the dancer roll.

BRIEF DESCRIPTION OF THE DRAWINGS

The present invention will be more fully understood and further advantages will become apparent when reference is made to the following detailed description of the invention and the drawings, in which.

DETAILED DESCRIPTION OF THE ILLUSTRATED EMBODIMENTS

The following detailed description is made in the context of a converting process. The invention can be appropriately applied to other flexible web processes.

Figure 1:
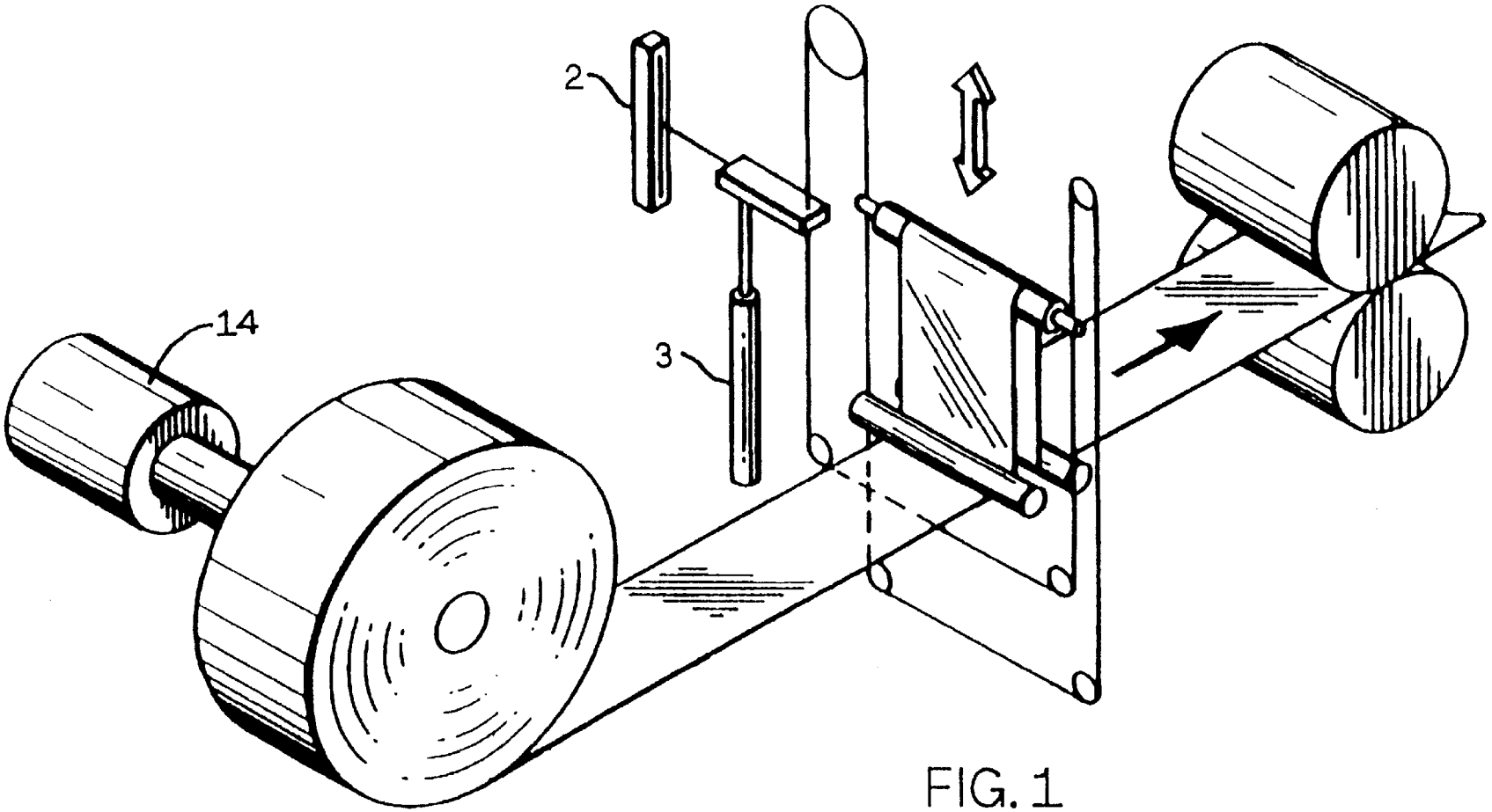
FIG. 1 PRIOR ART
FIG. 1 is a pictorial view of part of a conventional processing operation, showing a dancer roll adjacent the unwind station.

FIG. 1 illustrates a typical conventional dancer roll control system. Speed of advance of web material is controlled by an unwind motor 14 in combination with the speed of the nip downstream of the dancer roll. The dancer system employs lower turning rolls before and after the dancer roll, itself. The dancer roll moves vertically up and down within the operating window defined between the lower turning rolls and the upper turning pulleys in the endless cable system. The position of the dancer roll in the operating window, relative to (i) the top of the window adjacent the upper turning pulleys and (ii) the bottom of the window adjacent the turning rolls is sensed by position transducer 2. A generally static force having a vertical component is provided to the dancer roll support system by air cylinder 3.

In general, to the extent the process take-away speed exceeds the speed at which the web of raw material is supplied to the dancer roll, the static forces on the dancer roll cause the dancer roll to move downwardly within its operating window. As the dancer roll moves downwardly, the change in position is sensed by position transducer 2, which sends a corrective signal to unwind motor 14 to increase the speed of the unwind. The speed of the unwind increases enough to return the dancer roll to the mid-point in its operating window.

By corollary, if the take-away speed lags the speed at which web material is supplied to the dancer roll, the static forces on the dancer roll cause the dancer roll to move upwardly within its operating window. As the dancer roll moves upwardly, the change in position is sensed by position transducer 2. As the dancer rises above the mid-point in the operating window, the position transducer sends a corresponding corrective signal to unwind motor 14 to decrease the speed of the unwind, thereby returning the dancer roll to the mid-point in the operating window.

The above conventional dancer roll system is limited in that its response time is controlled by the gravitational contribution to vertical acceleration of the dancer roll, and by the mass of equipment in e.g. the unwind apparatus that must change speed in order to effect a change in the unwind speed.

Figure 2:
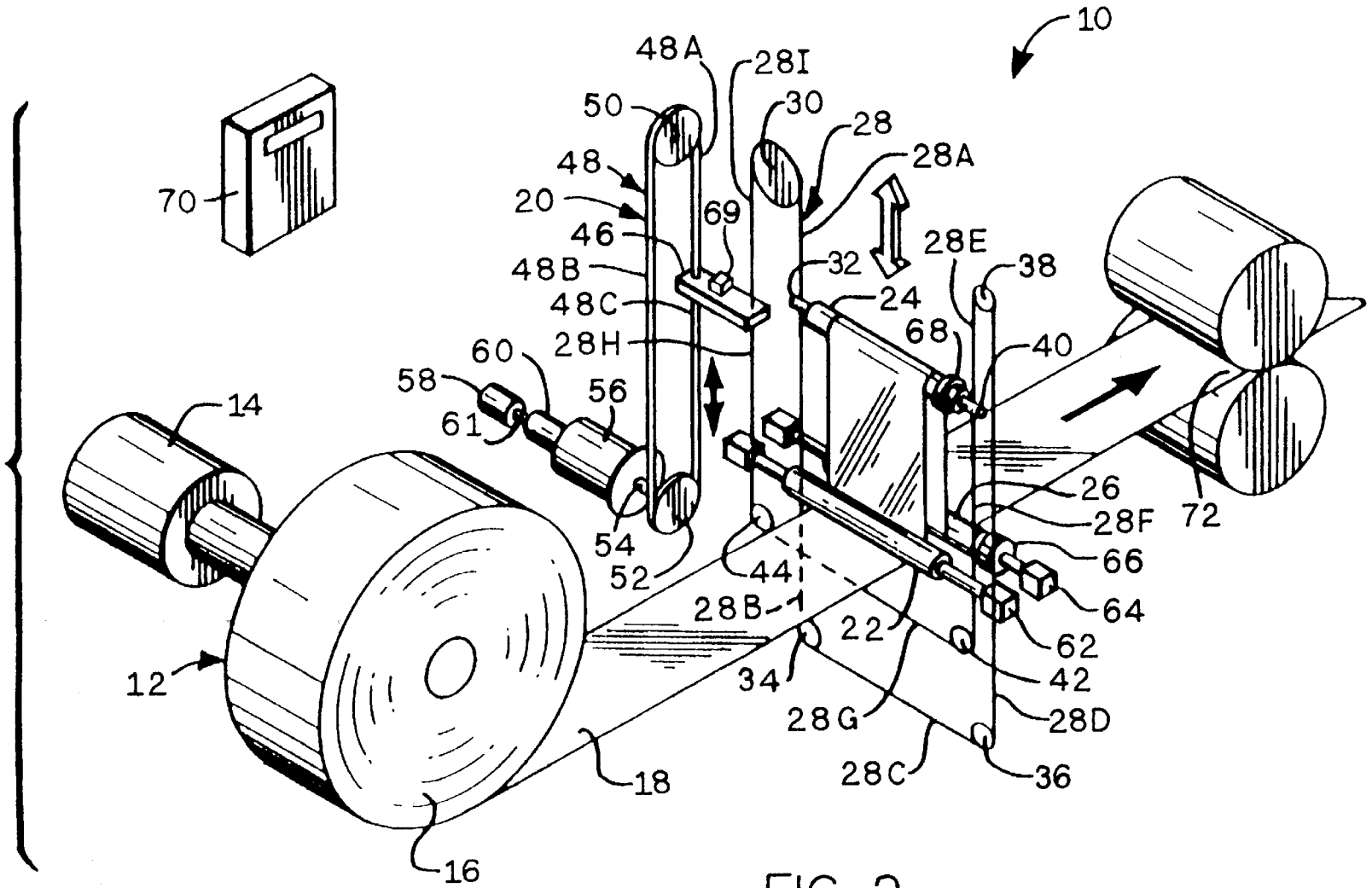
FIG. 2 is a pictorial view of one embodiment of the invention, again showing a dancer roll adjacent the unwind station.

Referring to FIG. 2, the process system 10 of the invention incorporates an unwind 12, including unwind motor 14 and roll 16 of raw material. A web 18 of the raw material is fed from roll 16, through a dancer system 20, to the further processing elements of the converting process downstream of dancer system 20.

In the dancer system 20, web of material 18 passes under turning roll 22 before passing over the dancer roll 24, and passes under turning roll 26 after passing over the dancer roll 24. As shown, dancer roll 24 is carried by a first endless drive cable 28.

Starting with a first upper turning pulley 30, first endless drive cable 28 passes downwardly as segment 28A to a first end 32 of dancer roll 24, and is fixedly secured to the dancer roll at first end 32. From first end 32 of dancer roll 24, drive cable 28 continues downwardly as segment 28B to a first lower turning pulley 34, thence horizontally under web 18 as segment 28C to a second lower turning pulley 36. From second lower turning pulley 36, the drive cable passes upwardly as segment 28D to a second upper turning pulley 38. From second upper turning pulley 38, the drive cable extends downwardly as segment 28E to second end 40 of dancer roll 24, and is fixedly secured to the dancer roll at second end 40. From second end 40 of dancer roll 24, the drive cable continues downwardly as segment 28F to a third lower turning pulley 42, thence back under web 18 as segment 28G to fourth lower turning pulley 44. From fourth lower turning pulley 44, the drive cable extends upwardly as segment 28H to, and is fixedly secured to, connecting block 46. From connecting block 46, the drive cable continues upwardly as segment 28I to first upper turning pulley 30, thus completing the endless loop of drive cable 28.

Connecting block 46 connects the first endless drive cable 28 to a second endless drive chain 48. From connecting block 46, second endless drive chain 48 extends upwardly as segment 48A to a third upper turning pulley 50. From upper turning pulley 50, the endless drive chain extends downwardly as segment 48B to fifth lower turning pulley 52. From fifth lower turning pulley 52, the drive chain extends back upwardly as segment 48C to connecting block 46, thus completing the endless loop of drive chain 48.

Shaft 54 connects fifth lower turning pulley 52 to a first end of actuator apparatus 56. Dancer roll position sensor 58 and dancer roll translational velocity sensor 60 extend from a second end of actuator apparatus 56, on shaft 61.

Load sensors 62, 64 are disposed on the ends of turning rolls 22, 26 respectively for sensing stress loading on the turning rolls transverse to their axes, the stress loading on the respective turning rolls being interpreted as tension on web 18.

Velocity sensor 66 is disposed adjacent the end of turning roll 26 to sense the turn speed of turning roll 26. Velocity sensor 68 is disposed adjacent second end 40 of dancer roll 24 to sense the turn speed of the dancer roll, the turning speeds of the respective rolls being interpreted as corresponding to web velocities at the respective rolls.

Acceleration sensor 69 is disposed on connecting block 46 and thus moves in tandem with dancer roll 24. Acceleration sensor 69 senses acceleration on dancer roll in response to acceleration of connecting block 46. Of course, the direction of acceleration for connecting block 46 is directly opposite to the direction of acceleration of dancer roll 24. Therefore, the direction of the sensed acceleratior is given an opposite value to the actual value of the acceleration of connecting block 46.

Acceleration sensor 69 can also be mounted in proper orientation to selected segments such as 28A, of drive cable 28 moving in the same direction as dancer roll 24, or directly on the dancer roll. The acceleration of dancer roll 24 is measured and sent to computer controller 70.

Dancer system 20 is controlled by computer controller 70. Computer controller 70 is a conventional digital computer, which can be programmed in conventional languages such as "Basic" language, "Pascal" language, "C" language, or the like. Such computers are generically known as "personal computers," and are available from such manufacturers as Compaq and IBM.

Position sensor 58, velocity sensors 60, 66, 68, load sensors 62, 64 and acceleration sensor 69 all feed their inputs into computer controller 70. Computer controller 70 processes the several inputs, computing a velocity set point or target velocity using the equation:

$$V^*_p=[EA_o/(EA_o-F_c)][V_2(1-F_b/EA_o)-V_3(1-F_c/EA_o)],$$

where: $V_2$=Velocity of web 18 at dancer roll 24, $V_3$=Velocity of the web after the dancer roll, $V^*_p$=target translational velocity of the dancer roll 24, to be reached if the set point $V^*_p$ is not subsequently adjusted or otherwise changed, E=Actual modulus of elasticity of the web, $A_o$=Actual cross-sectional area of the unstrained web, $F_b$=Tension in the web ahead of the dancer roll, and $F_c$=Tension in the web after the dancer roll.

In one embodiment a target translational acceleration or acceleration set point is calculated using the equation:

$$A^*_p=[V^*_p-V_p]/\Delta T$$

where: ΔT =the scan time for the control system, and $A^*_p$=target translational acceleration command of dancer roll 24, to be reached if the set point $A^*_p$ is not subsequently adjusted or otherwise changed.

Using the calculated target acceleration $A^*_p$, a target actuator apparatus force command is generated using the equation:

$$F^*_{servo}=F^*_{d\ static}+F^*_{friction}\mathrm{Sign}(V_p)+b_a(V^*_p-V_p)+k_a(F^*_c-F_c)+M_a(A^*_p-A_p)+A^*_pM_e],$$

where: $F^*_{d\ static}=M_2g+2F^*_c$, in combination with $F^*_{frictin}\mathrm{Sign}(V_p)$, comprises a first force component having a static force in the equation. The above equation utilizes the following constants and variables:

$F^*_{d\ static}$=Static vertical force component on the dancer roll, $F^*_{friction}$=Friction, in either direction, resisting movement of the dancer roll, $F^*_c$=Target tension in web 18 after dancer roll 24 comprising a target set point, per process design parameters, $F^*_{servo}$=Force generated by actuator apparatus 56, preferably a servo-motor, $b_a$=Force control gain constant re dancer translational velocity, in newton seconds/meter, predetermined by user as a constant, $k_a$=Force control loop gain,=(P times $K_f$)/($E_e$ times $A_{oe}$)

$K_f$=Active spring constant, $M_2g$=Actual physical mass of dancer roll system times gravity, $M_{2e}$=Estimated physical mass of dancer roll, $M_a$=Active mass of the dancer roll, $M_e$=Effective mass defined as Active mass plus physical mass of the dancer roll ($M_2$+$M_a$), $V_p$=Instantaneous vertical velocity of the dancer roll immediately prior to application of the second variable vertical force component, vertical velocity equaling the translational velocity of dancer roll 24 within its operating window, $\mathrm{Sign}(V_p)$=positive or negative value depending on the direction of movement of the dancer roll, $A_p$=actual translational acceleration of the dancer roll immediately prior to application of the second variable vertical force component, ΔP=Change in dancer position in translational direction, P=Dancer position in translational direction, within operating window, $E_e$=Estimate of modulus of elasticity of the web, $A_{oe}$=Estimate of cross-sectional area of the unstrained web, and ZOH=Zero Order Hold or Latch (holds last force command value).

The overall torque applied by actuator apparatus 56 can be described by the equation:

$$T^*_{dancer}=r[F^*_{servo}]$$

using the following variables $T^*_{dancer}$=actuator apparatus torque command or force, and r=Radius of pulley on the actuator apparatus.

The response time is affected by the value selected for the gain constant, "$b_a$." The gain constant "$b_a$" is selected to impose a damping effect on especially the variable force component of the response, in order that the Active variable component of the response not make dancer roll 24 so active as to become unstable, such as where the frequency of application of the responses approaches a natural resonant frequency of the web and dancer roll. Accordingly, the gain constant "b" acts somewhat like a viscous drag in the system. For example, in a system being sampled and controlled at 1000 times per second, where the mass of dancer roll 24 is 1 kg, a suitable control gain constant "$b_a$" is 2.

Similarly, the gain constant "$k_a$" compensates generally for web tension errors in the system. A suitable gain constant "$k_a$" for the instantly above described processing system is 20. The gain constants "$b_a$" and "$k_a$" vary depending on the sampling rate of the system.

It is contemplated that the operation and functions of the invention have become fully apparent from the foregoing description of elements and their relationships with each other, but for completeness of disclosure, the usage of the invention will be briefly described hereinafter.

Figure 3:
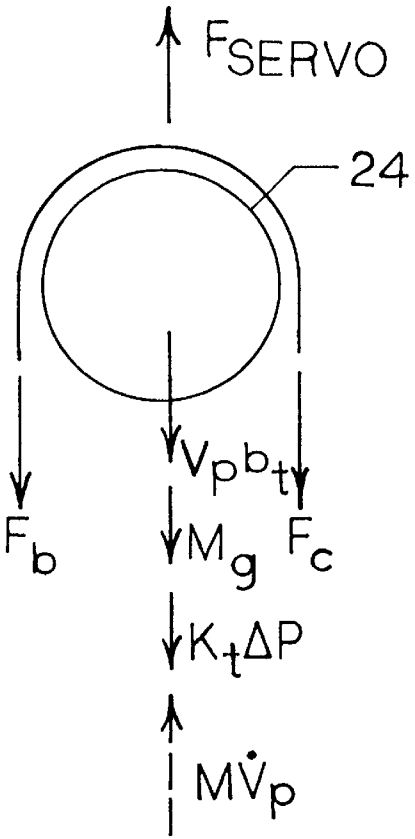
FIG. 3 is a free body force diagram showing the forces acting on the dancer roll.

In order for dancer roll 24 to operate as a "dancer" roll, the several forces acting on the dancer roll must, in general, be balanced, as shown in FIG. 3. FIG. 3 illustrates the forces being applied by the actuator apparatus 56 balanced against the tension forces in web 18, the weight of dancer roll 24, any existing viscous drag effects times the existing translational velocity $V_p$ of the dancer roll, any existing spring effect $K_f$ times the change in positioning ΔP of the dancer roll, and dancer mass $M_2$ times its vertical acceleration at any given time.

Throughout the application the phrases "actuator apparatus", as well as servo motor, and $F^*_{servo}$ are utilized. All of the phrases refer to an apparatus applying force to dancer roll 24. Such actuators can be conventional motors, rotating electric motors, linear electric motors, pneumatic driven motors, or the like. The phrase "$F_{servo}$" does not infer, or imply a specific type of motor in this application.

The actuator force $F_{servo}$ generally includes a first generally static force component $F^*_{d\ static}$, having a relatively fixed value, responsive to the relatively fixed static components of the loading on the dancer roll. The generally static force component $F^*_{d\ static}$ provides the general support that keeps dancer roll 24 balanced (vertically) in its operating window, between turning rolls 22, 26 and upper turning pulleys 30 and 38, responding based on the static force plus gravity. To the extent dancer roll 24 spends significant time outside a central area of the operating window, computer controller 70 sends conventional commands to the line shaft drivers or the like to adjust the relative speeds between e.g. unwind 12 and nip 72 in the conventional way to thus bring the dancer roll generally back to the center of its operating window.

The actuator apparatus force $F_{servo}$ optionally can include the force component $F^*_{friction}$, that relates to the force of friction overcome to begin moving dancer roll 24 in a translational direction, or to continue movement of the dancer roll. A value for the force component $F^*_{friction}$ can comprise a second static force value selected according to the particulars of dancer system 20. The force component $F^*_{friction}$ is then added or subtracted from the overall force applied by actuator apparatus 56 depending on the direction of movement of dancer roll 24.

In other embodiments, force component $F^*_{friction}$ can be varied by computer controller 70 depending on the velocity of dancer roll 24. For example, when dancer roll 24 is stationary (not moving in either direction), force component $F^*_{friction}$ requires a greater force to initiate movement in a given direction. Likewise, after dancer roll 24 begins moving in a given direction, the amount of friction resisting the continued movement of the dancer roll is less than the at-rest friction resisting dancer roll movement. Therefore, the value of force component $F^*_{friction}$, decreases during movement in a given direction. Computer controller 70, in response to sensed velocity $V_p$ can appropriately change the value of force component $F^*_{friction}$ as needed, for use in the equations described earlier controlling dancer roll 24.

In other embodiments, the force component $F^*_{friction}$ need not be accounted for depending on the accuracy required for the overall system. However, computer controller 70 generally can be utilized to at least store a constant value that can be added or subtracted to the force applied by the servo-motor. Accounting for force component $F^*_{friction}$ generally improves the operation of dancer system 20.

In addition to the static force component $F^*_{d\ static}$ and the force component $F^*_{friction}$, actuator apparatus 56 exerts a dynamically active, variable force component, responsive to tension disturbances in web 18. The variable force component, when added to the static force component, comprehends the net vertical force command issued by computer controller 70, to actuator apparatus 56. Actuator apparatus 56 expresses the net vertical force command as torque $T^*_{dancer}$ delivered through drive chain 48, drive cable 28, and connecting block 46, to dancer roll 24.

Accordingly, in addition to the normal passive response of dancer roll 24, based on such static forces as mass, gravity, and web tension, dancer system 20 of the invention adds a dynamic control component, outputted at actuator apparatus 56. The result is a punctuation of the normal dancer system response characteristic with short-term vertical forces being applied to dancer roll 24 by actuator apparatus 56, with the result that the dancer roll is much more pro-active, making compensating changes in translational velocity and translational acceleration much more frequently and accurately than a conventional dancer system that responds only passively. Of course, net translational velocity or net translational acceleration, at any given point in time, can be a positive upward movement, a negative downward movement, or no movement at all, corresponding to zero net translational velocity and/or zero net translational acceleration, depending on the output force command from computer controller 70. Computer controller 70, of course, computes both the value and direction of the variable force, as well as the net force $F^*_{servo}$.

Figure 4:
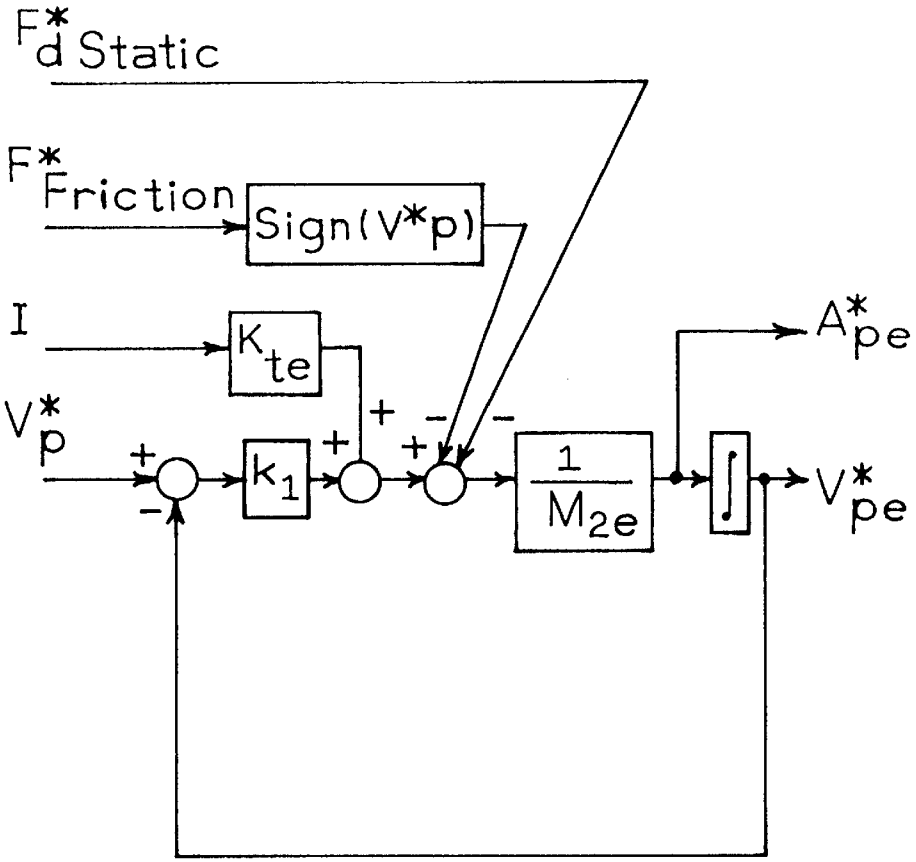
FIG. 4 is a control block diagram for an observer computing a set point for the desired translational acceleration of the dancer roll.

Another system for indirectly determining a set point for translational acceleration $A^*_p$ or target translational acceleration, is set forth in the observer of block diagram of FIG. 4.

The observer of FIG. 4. and observers shown in other FIGURES that follow, all model relationships between physical properties of elements of dancer system 20. In some embodiments, the observer merely comprises a computer program or subroutine stored in computer controller 70. In other embodiments, the respective observers can comprise discrete electronic circuitry separate from computer controller 70. The various observers disclosed herein all model various physical properties of the different elements of the various dancer systems.

In the observer of FIG. 4, an equation for a target set point for estimates acceleration $A^*_{pe}$ (Force applied divided by mass), is defined as follows:

$$A^*_{pe}=[k_1(V^*_p-V^*_{pe})+k_{te}I-F^*_{d\ static}-F^*_{friction}\mathrm{Sign}(V_p)]/M_{2e}$$

where, $k_1$=Observer gain

I=Actuator apparatus current $k_{te}$=Actuator apparatus torque constant estimate $M_{2e}$=Estimated physical mass of dancer roll 24

$A^*_{pe}$=Acceleration command estimate, target net acceleration (not a measured value)

$V^*_{pe}$=Translational velocity estimate or target for the dancer roll

Therefore, estimated target acceleration $A^*_{pe}$ can be calculated from known parameters of the system using the above block diagram showing the observer of FIG. 4.

Likewise, a similar block diagram for the observer shown in FIG. 5 can utilize the following equation to estimate actual acceleration Ape as follows:

$$A_{pe}=[k_1(V_p-V_{pe})+k_{te}I-F^*_{d\ static}-F^*_{friction}\mathrm{Sign}(V_p)]/M_{2e}$$

where, $A_{pe}$=Estimate of actual translational acceleration of dancer roll (not a measured value), and $V_{pe}$=Estimate of actual translational velocity of dancer roll.

Figure 5:
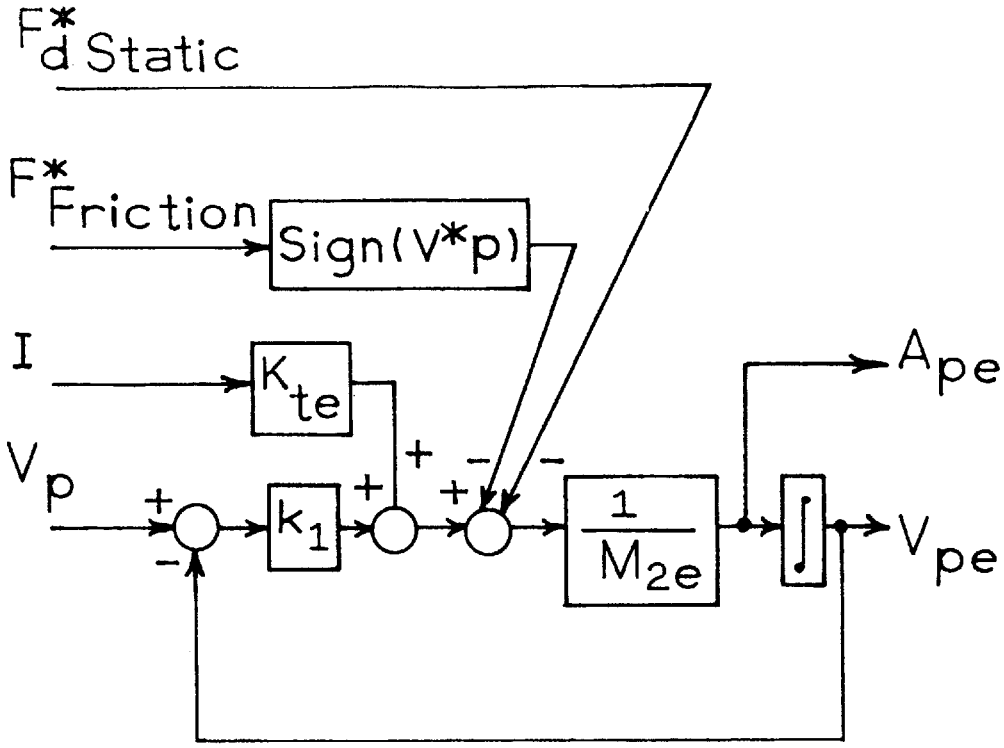
FIG. 5 is a control block diagram for an observer computing translational acceleration of the dancer roll from the dancer translational velocity command.

Therefore, estimated actual acceleration can quickly be computed from known parameters of the system using the observer of FIG. 5.

Of course, another way of determining actual translational acceleration of the dancer roll is utilizing the following equation:

$$A_{pe}=[V_p(\mathrm{present})-V_p(\mathrm{previous})]/\Delta T$$

where $\Delta T\times$the scan time for process system 10. In this manner, average actual translational acceleration Ape also can be determined without direct measurement of acceleration.

Figure 6:
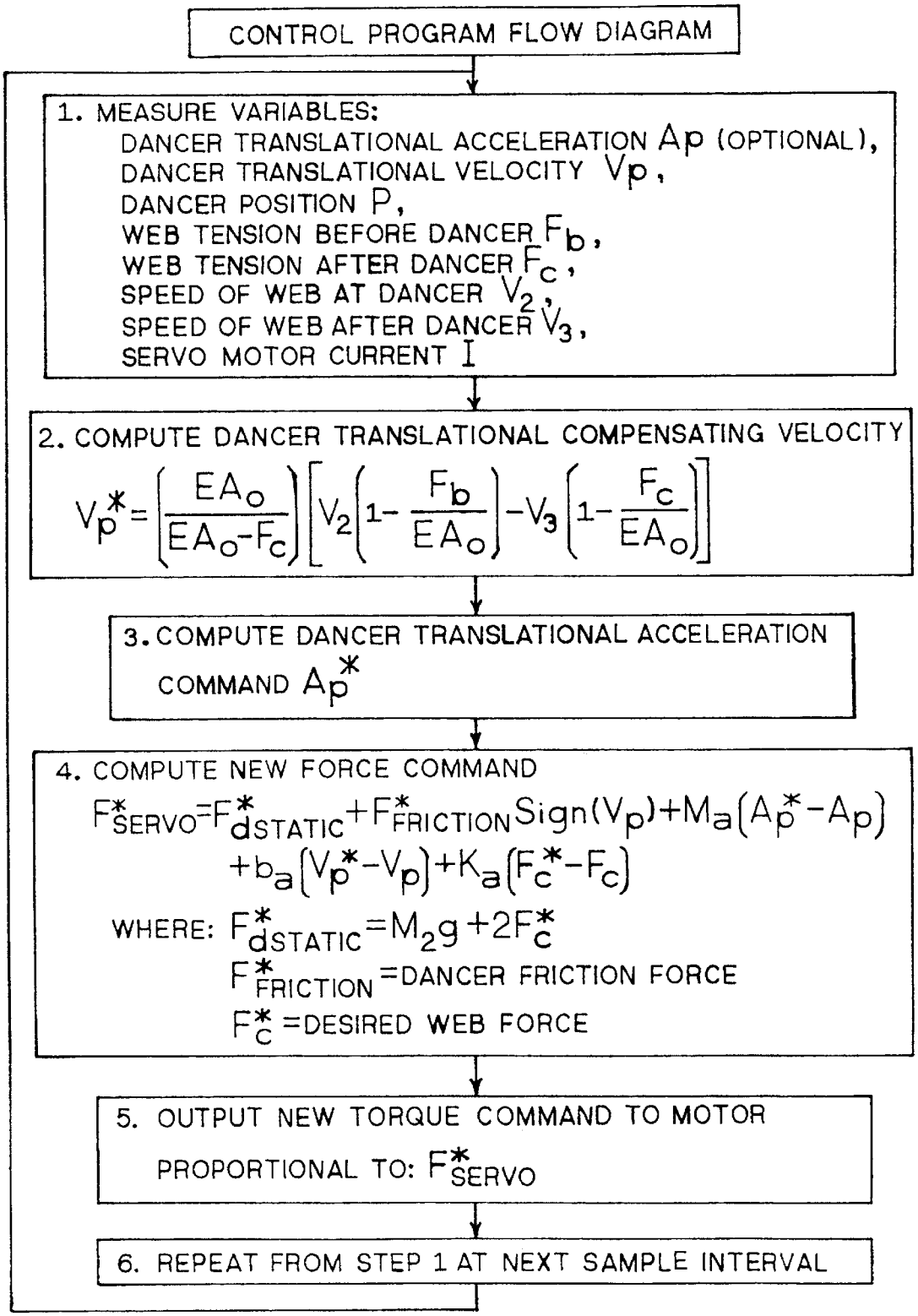
FIG. 6 is a program control flow diagram representing a control system for a first embodiment the invention.
Figure 7:
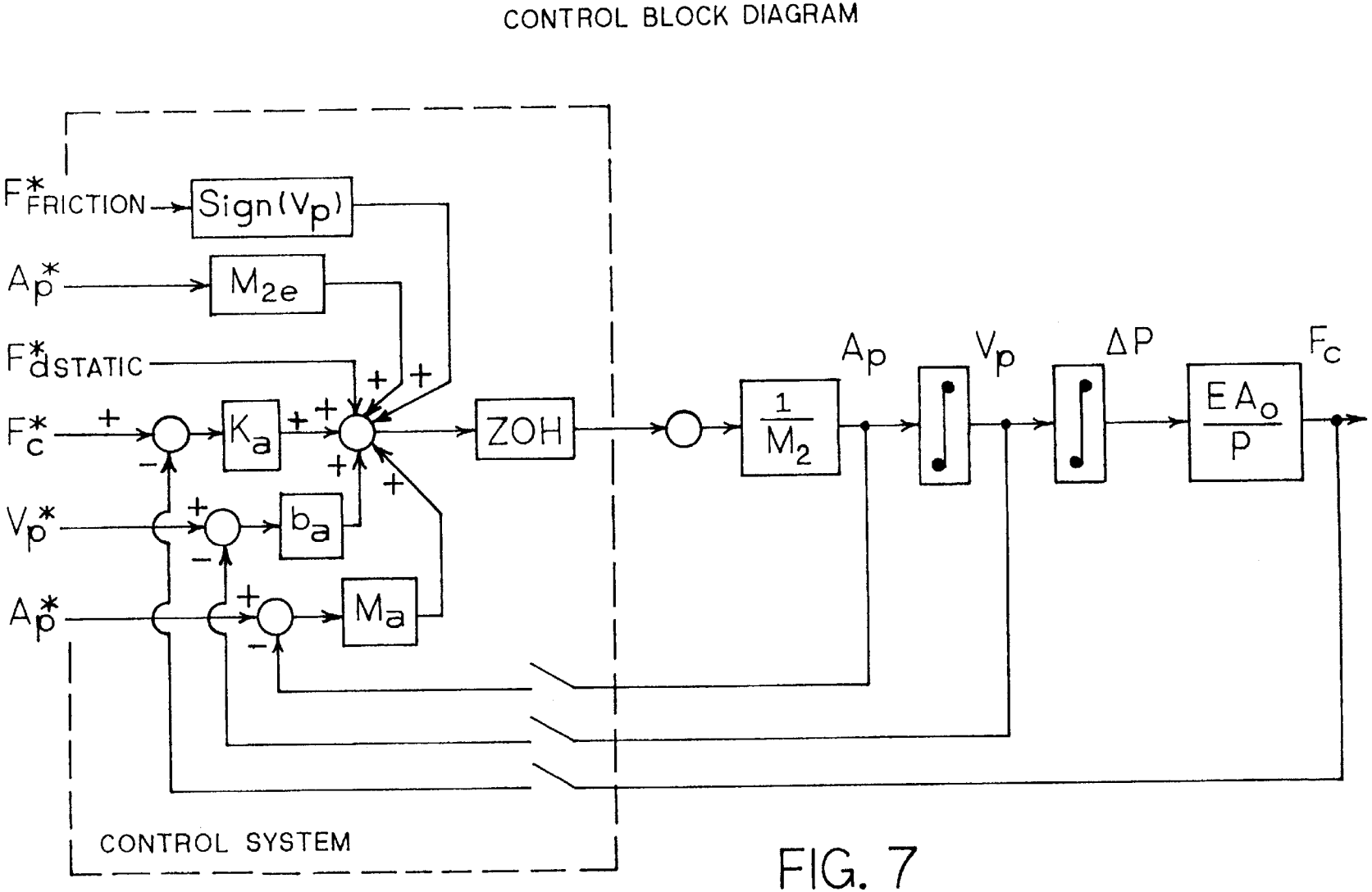
FIG. 7 is a control block diagram for the control flow diagram of FIG. 6.

The calculations set forth in FIGS. 4 and 5, when incorporated into the system set forth in the control program flow diagram and control block diagram of FIGS. 6 and 7. enable dancer system 20 to function effectively without direct measurement of acceleration $A_p$ (optional). Thus, in the embodiments shown, accelerometer 69 can be an optional element depending on the processing system, and computer program, being utilized.

The general flow of information and commands in a command sequence used in controlling the dancer system 20 is shown in the control program flow diagram of FIG. 6. In step 1 in the command sequence, the variable parameters $A_p$ (some embodiments), $V_p$, P, $F_b$, $F_c$, $V_2$, $V_3$, and I (some embodiments) are measured. Acceleration $A_p$ can also be estimated indirectly $A_{pe}$, instead of being measured, as disclosed in the equations described earlier.

In step 2, the variables are combined with the known constants in computer controller 70, and the controller computes $V^*_p$, a set point for the desired or target translational velocity of dancer roll 24.

In step 3, $V^*_p$ can be combined with $V_p$ and divided by scan time ΔT to compute a value for $A^*_{pe}$. In another embodiment, as shown in FIG. 4. the observer can utilize motor current I, set point $V^*_p$, and the other variables or constants shown to estimate the target translational acceleration as described earlier.

In step 4, a new command $F^*_{servo}$ is computed using the computed variables and constants $F^*_{d\ static}$, $F^*_{friction}$, $F_c$, $F^*_c$, $b_a$, $k_a$, $V_p$, Sign($V_p$), $A_p$, $A^*_p$, $V^*_p$, and $M_a$.

In step 5, the new force command $F^*_{servo}$ is combined with a servo constant "r" (radius) to arrive at the proportional torque command $T^*_{dancer}$ output from actuator apparatus 56 to dancer roll 24 through drive chain 48 and drive cable 28.

In step 6, the sequence is repeated as often as necessary, preferably at predetermined desired sample intervals (scan time ΔT or computation frequency) for the system to obtain a response that controls the tension disturbances extant in web 18 under the dynamic conditions to which the web is exposed.

In a first embodiment of a method of using the invention, a primary objective of dancer system 20 is to attenuate tension disturbances in web 18. Such tension disturbances might come, for example from unintended, but nonetheless normal, vibrations emanating from equipment downstream of dancer roll 24. Bearing vibration, motor vibration, and other similar occurrences are examples of sources of vibration that may affect the system. In the alternative, such tension disturbances can also be intentionally imposed on web 18 as the web is processed. An example of such intentional tension disturbances is shown in U.S. Pat. No. 4,227,952 to Sabee, herein incorporated by reference to show a tension disturbance being created with the formation of each tuck or pleat in the web of material being processed.

Whether the tension disturbances are imposed intentionally or unintentionally, the effect on web 18 is generally the same. As web 18 traverses processing system 10. the web is exposed to an average dynamic tension, representing a normal range of tensions as measured over a span of the web, for example between roll 16 of raw material and the next nip 72 downstream of dancer system 20.

Tension and other conditions should be sensed at a scan time of at least 1 time per second, preferably at least 5 times per second, more preferably at least 500 times per second, and most preferably at least 1000 times per second. Likewise, computer controller 70 preferably recomputes the net force $F_{servo}$ applied to dancer roll 24 at least 1 time per second, preferably at least 5 times per second, more preferably at least 500 times per second, and most preferably at least 1000 times per second. Faster scan times and computation rates improve the web tension control of dancer system 20 and the overall operating characteristics of process system 10.

Since, as discussed above, the first step in the control cycle is sensing/measuring the several variables used in computing the variable force component of the response, it is critical that the sensors measure the variables frequently enough, to detect any tension disturbance that should be controlled early enough, to respond to and suppress the tension disturbance. Thus having a short scan time (large frequency) is important to the overall operation of process system 10.

In order to have proper control of dancer system 20, it is important that the computed responses be applied to dancer roll 24 frequently enough to control the dancer system. Thus, at least 5 responses during the period of any tension disturbance is preferred. In order to provide sufficient frequency in the response application, especially where there is a variation in the frequency of occurrence of tension disturbances, it is preferred to measure the variables and apply a response at a multiple of the anticipated disturbance frequency.

Overall, the most critical frequency is the frequency at which steps 1 through 6 are executed in the Flow Diagram of FIG. 6.

Dancer system 20 of this invention can advantageously be used with any dancer roll, at any location in the processing line. If there are no abrupt disturbances in web 18. dancer roll 24 will operate like a conventional dancer roll. Then, when abrupt disturbances occur, control system 20 will automatically respond, to attenuate any tension disturbances.

Referring to FIG. 7 showing the control block diagram of the first embodiment, the dashed outline, represents calculations that occur inside computer controller 70, with the resultant force output $F^*_{servo}$ being the output applied to actuator apparatus 56 via Zero Order Hold (ZOH). FIG. 7 illustrates the relationship between dancer roll acceleration $A_p$, dancer roll velocity $V_p$, change in position ΔP, and web tension $F_c$ downstream of dancer roll 24. Integration symbols in boxes merely illustrate the relationship between the various sensed elements.

In some embodiments, the integration symbols, contained in a block, such as in FIG. 7, illustrate a physical integration. The integration block in FIG. 7, as well as in other FIGURES can comprise an operational amplifier or other separate physical circuit, as well as a computer software routine in computer controller 70 that integrates the value input. Operation of the control block diagram of FIG. 7 generally corresponds to the above described relationship in the control program flow diagram of FIG. 6 and the observers of FIGS. 4 and 5.

Zero order hold (ZOH), found in all of the embodiments, comprises a latch that stores and then outputs as appropriate, the computed value for $F^*_{servo}$. Other elements having an equivalent function can be substituted for the zero order hold element.

RELATIONSHIP OF ACTIVE MASS GAIN AND ACTUAL SYSTEM MASS

The relationship between active mass gain and actual mass gain assists the system in providing inertia compensation to process system 10.

Using block diagram algebra and neglecting the zero order hold dynamics, the closed loop system equation for the acceleration loop is:

$$A_p/A^*_p=M_a/(M_2+M_a)$$

From the above equation, the effective system mass for dancer system 20 is $M_e=M_2+M_a$.

Inertia compensation for dancer system 20 can be obtained by adjusting $M_a$ such that:

$$M_a=[J_2/(R_2)^2]-M_2$$

Where:

$J_2$=Polar inertia of dancer roll $R_2$=Outer radius of dancer roll $M_2$=System mass Solving the above equation for inertia compensation enables dancer system 20 to operate as an effective inertia compensated system. U.S. Pat. No. 3,659,767 to Martin, hereby incorporated by reference in its entirety, discloses a tension regulation apparatus using a flywheel to physically produce an apparatus having inertia compensation.

Using computer controller 70, the invention enables computer control and adjustment of $M_a$ such that dancer system 20 is inertially balanced without utilizinc physical weights. Thus, the system disclosed herein, permits computer controller, using the above equations to adjust to changes in polar inertia, system mass, or other conditions, while maintaining dancer system 20 in an inertially compensated state.

Measuring all of the values set forth in box 1 of the control program flow diagram of FIG. 6 can be utilized to obtain extremely accurate results. However, in embodiments that follow, fewer conditions need to be sensed, and reasonably similar results are obtained. Thus, other embodiments have the advantage of fewer sensors that may fail and disable or skew the output results of computer controller 70. Therefore, all of the embodiments have unique advantages depending on the conditions required to be sensed.

Throughout the specification, the subscript notation "$_e$" is utilized to indicate when a value is estimated, or computed in such a manner that an exact, precise value generally is not received. For example, acceleration values "$A_{pe}$" and "$A_p$" can be considered interchangeable in use. In some embodiments, the value can be measured directly, such as by accelerometer sensor 69, and in other embodiments, the value can be estimated. For purposes of explanation, every occurrence of "$V_{pe}$" in the claims, can be considered to include "$V_p$", and vice versa, where no statement to the contrary is set forth therein. The interchangeability of actual and estimated values is not limited to the example of translational velocity listed above.

SECOND EMBODIMENT

Figure 8:
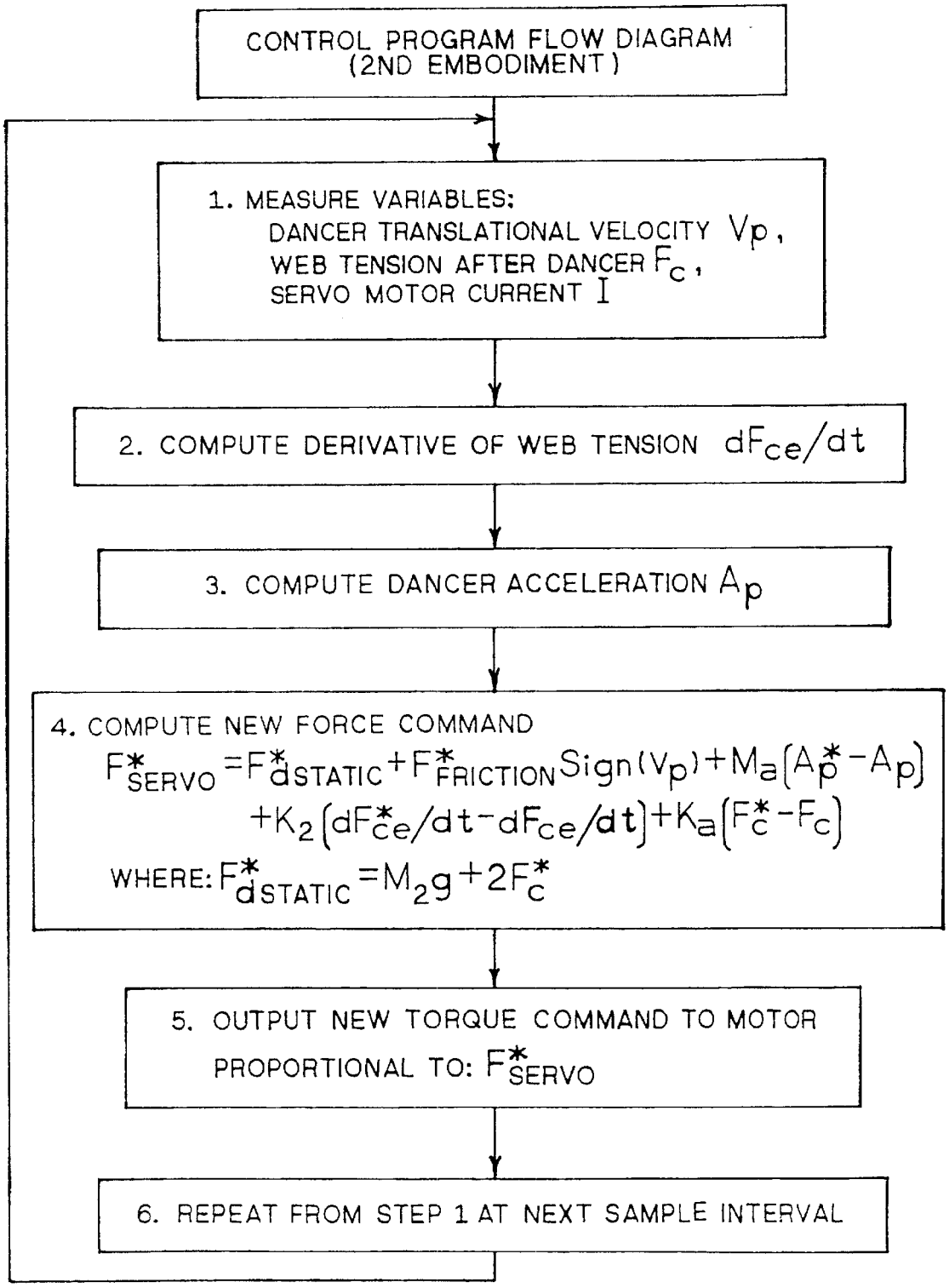
FIG. 8 is a control program flow diagram for a second embodiment of the invention.

FIG. 8 shows control program flow diagram for a second embodiment of the invention. In this embodiment, in step 1, the sensed variables are dancer translational velocity $V_p$, web tension $F_c$ after dancer roll 24, and actuator apparatus or servo motor current I are measured.

In step 2, the web tension derivative $dF_{ce}/dt$ is computed. In one method the average force derivative is estimated using the equation:

$$dF_{ce}/dt=[F_c(\text{present})-F_c(\text{previous})]/\Delta T$$

where $\Delta T$=scan time, $F_c$=measured web tensions (most resent and previous scans), and $dF_{ce}/dt$=derivative of web tension.

Thus, the derivative of web tension is simply calculated from changes in web tension over the time interval or scan time of the system.

In step 3, estimated dancer acceleration $A_{pe}$ can be computed using translational velocity as described earlier. Likewise, motor current I can be utilized, in combination with the other sensed values of step 1, to compute dancer acceleration $A_{pe}$.

In step 4, a new actuator apparatus force command $F^*_{servo}$ is computed using the computed variable values and stored constants $F^*_{d\ static}$, $F^*_{friction}$, $dF_c/dt$, $dF^*_c/dt$, $F_c$, $F^*_c$, $k_a$, $V_p$, Sign($V_p$), $A_p$, $A^*_p$, $b_a$, and $M_a$, respectively.

In step 5, the new force command $F^*_{servo}$ is combined with a servo constant "r" (radius) to arrive at the proportional torque command $T^*_{dancer}$ outputted from actuator apparatus 56 to dancer roll 24 through drive chain 48 and drive cable 28.

In step 6, the sequence is repeated as often as necessary, generally periodically, at desired sample intervals (scan time $\Delta T$ or computation frequency) that enable dancer system 20 to obtain a response that controls the tension disturbances extant in web 18 under the dynamic conditions to which the web is exposed.

Figure 9:
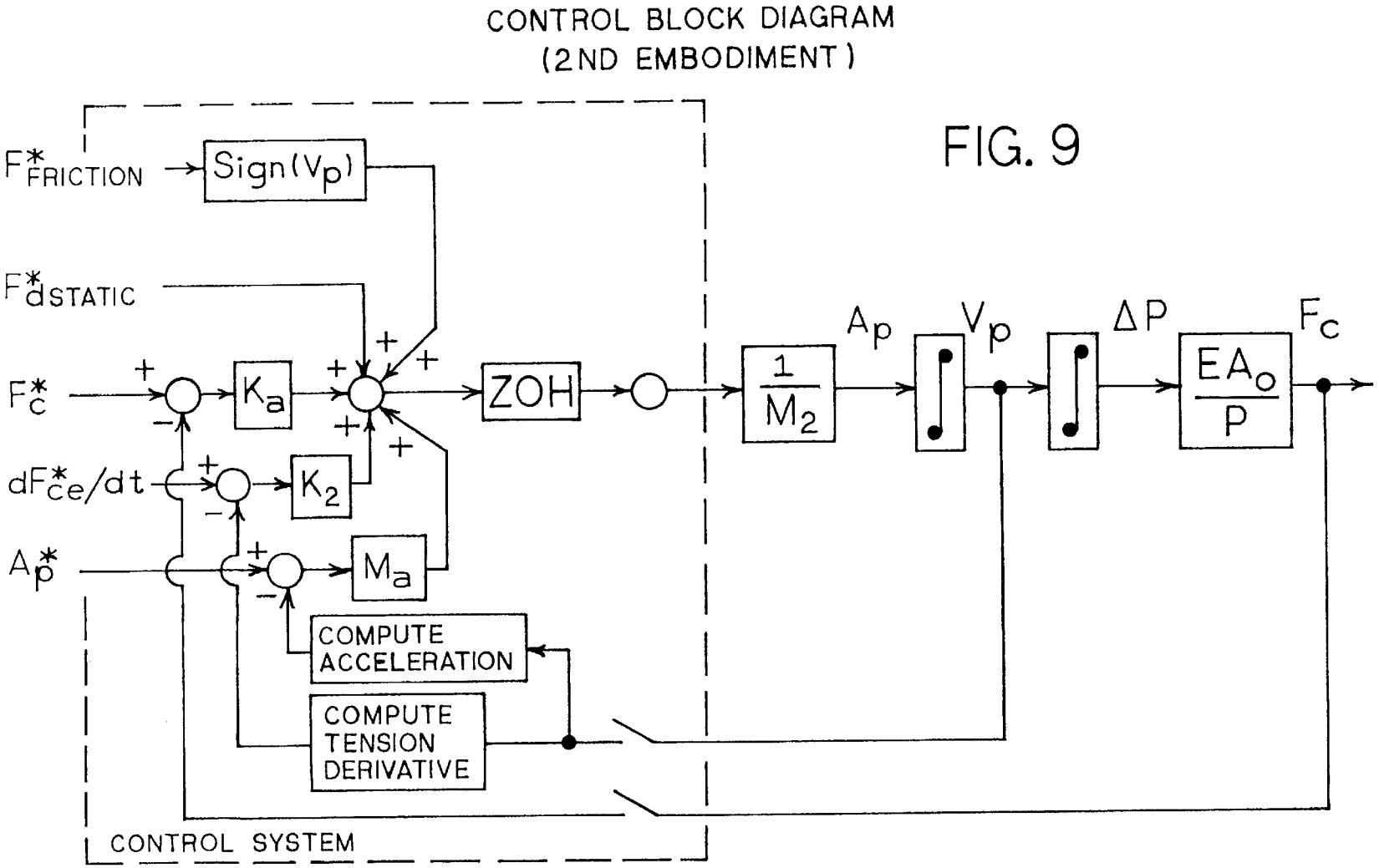
FIG. 9 is a control system block diagram for the control flow diagram of FIG. 8.

The second embodiment enables computer controller 70 to operate dancer system 20 in an active mode with better results than passive systems or dancer systems not accounting for acceleration properties. For ease of understanding, FIG. 9 shows a control block diagram illustrating the control program flow diagram of FIG. 8.

Figure 10:
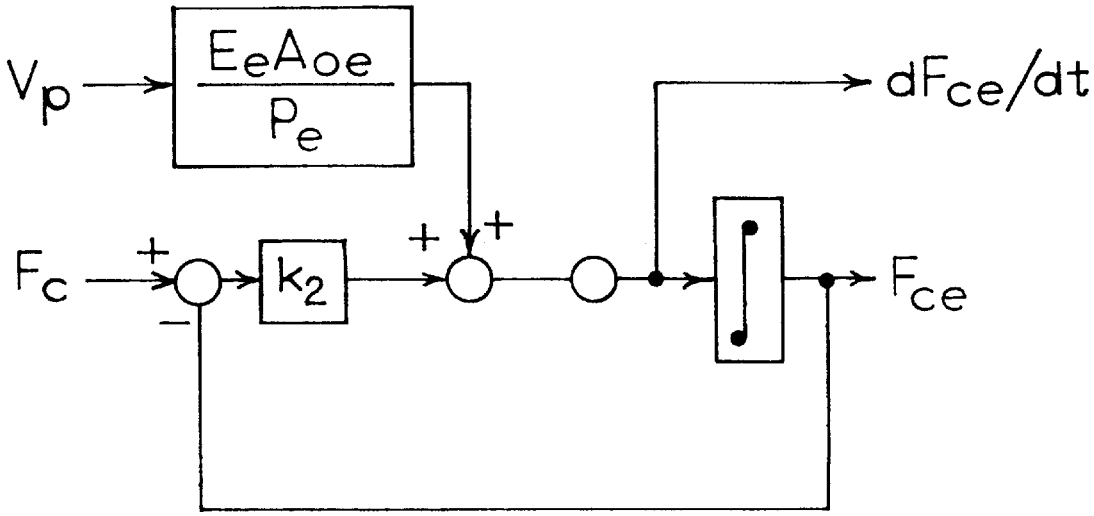
FIG. 10 is a control block diagram for an observer computing the derivative of web tension for the embodiment of FIGS. 8–9.

FIG. 10 illustrates an observer for estimating the derivative of web tension. Such an observer can comprise a separate electronic circuit performing calculations, or a subroutine in computer controller 70. The observer of FIG. 10 comprises a control block diagram showing physical results of the observer. The integration block in FIG. 10 can comprise an operational amplifier or computer software routine that integrates the derivative of force estimate and outputs an estimated web tension value. Thus the observer illustrated in FIG. 10 can be utilized to compute the derivative of web tension set forth in step 2.

In the observer of FIG. 10. the derivative of web tension is computed using the closed loop equation:

$$dF_{ce}/dt=k_2(F_c-F_{ce})+V_p(E_eA_{ce}/P_e)$$

where:

$k_2$=observer gain, $F_c$=web tension force, $F_{ce}$=estimated web tension force, $V_p$=translational velocity of the dancer roll, $E_e$=estimate of elastic modulus of the web, $A_{oe}$=estimate of the cross-sectional area of the web, and $P_e$=estimate of the position of the dancer roll.

The observer of FIG. 10 models the physical properties of dancer system 20 and assists in accurate control of web 18.

THIRD EMBODIMENT

Figure 11:
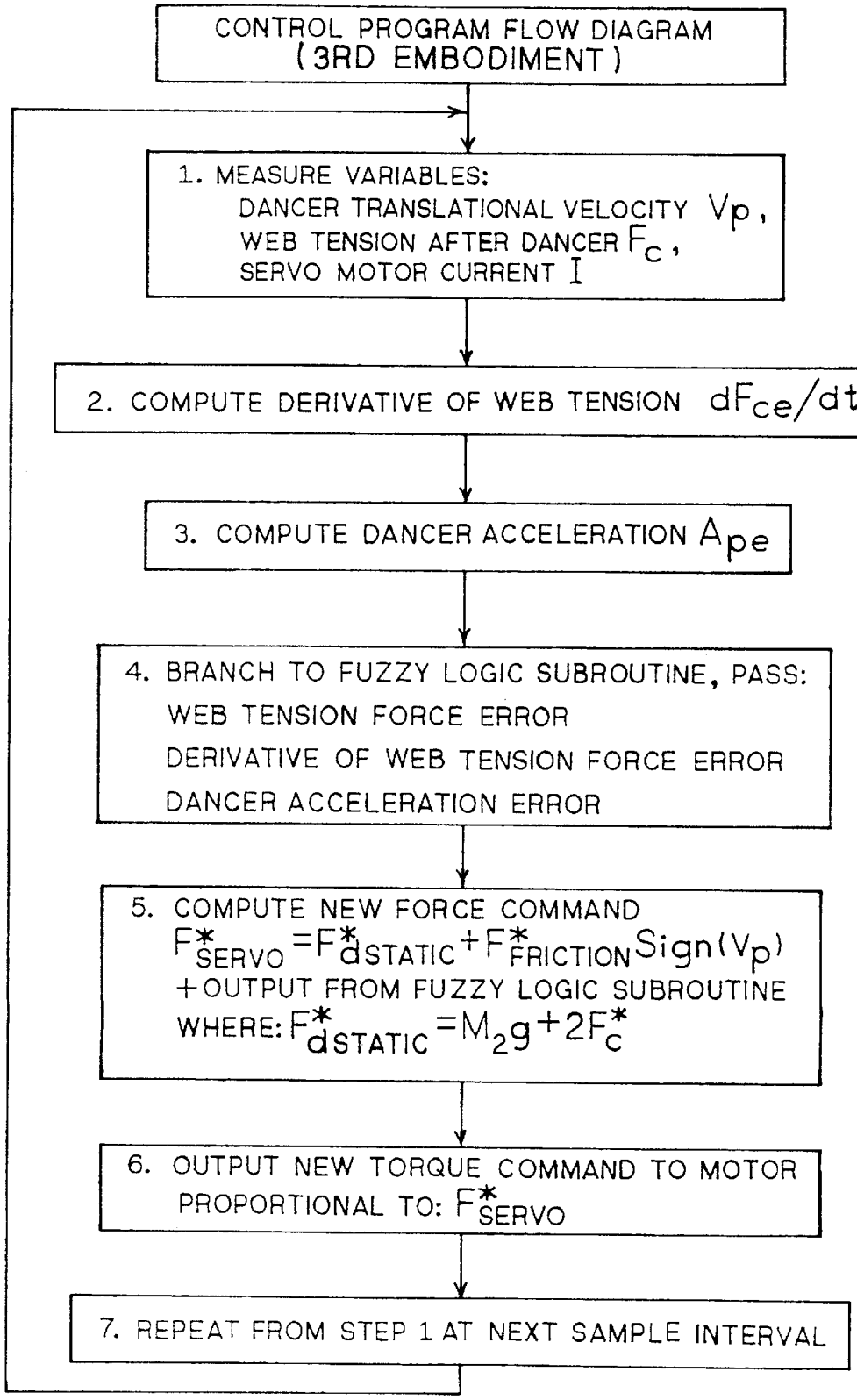
FIG. 11 is a control program flow diagram for a third embodiment of the invention.

FIG. 11 shows a control program flow diagram for a third embodiment of the invention. In this embodiment, in step 1, the variables of dancer translational velocity $V_p$, web tension $F_c$ after dancer roll 24, and actuator apparatus or servo motor current I are measured.

In step 2, the web tension derivative $dF_{ce}/dt$ is computed. In one method the average force derivative is estimated using the equation set forth earlier in the second embodiment. Of course, the derivative of web tension can also be estimated using the observer set forth earlier in FIG. 10 of the second embodiment.

In step 3, estimated dancer acceleration $A_{pe}$ can be computed using translational velocity, as described earlier. In another method for step 3, actuator apparatus current I can be utilized, in combination with the other sensed values of step 1, to compute dancer translational acceleration $A_{pe}$. Of course, in some embodiments, accelerometer 69 can be utilized to measure translational acceleration directly. Even though additional element 74, shown in FIG. 12, computes force derivative, such an additional element can be equivalent to the observer described earlier. Likewise additional element 76, shown in FIG. 12, for computing acceleration, can comprise the observer described earlier or other means for calculating or estimating acceleration.

Figure 12:
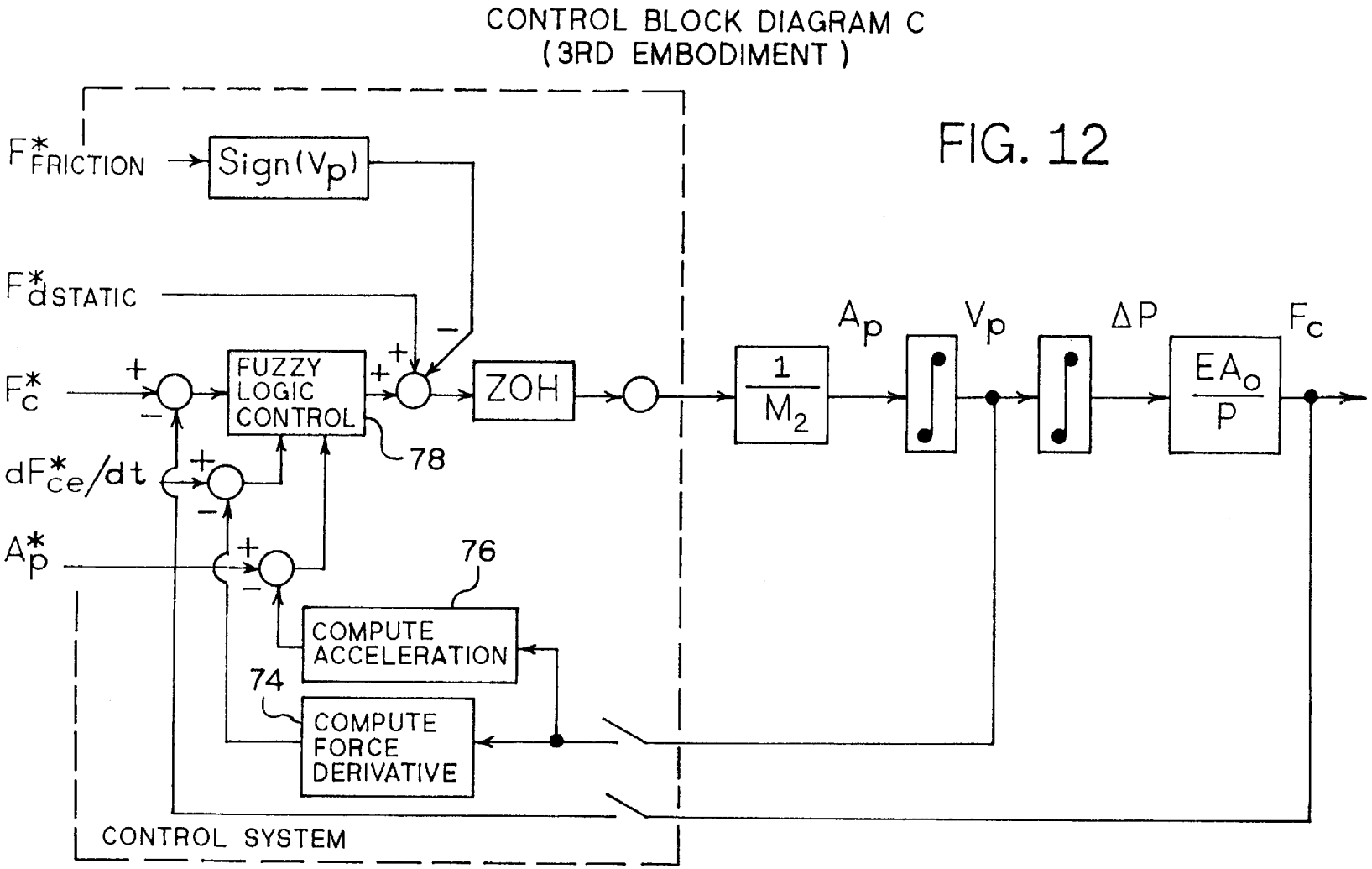
FIG. 12 is a control system block diagram for the control flow diagram of FIG. 11.
Figure 13:
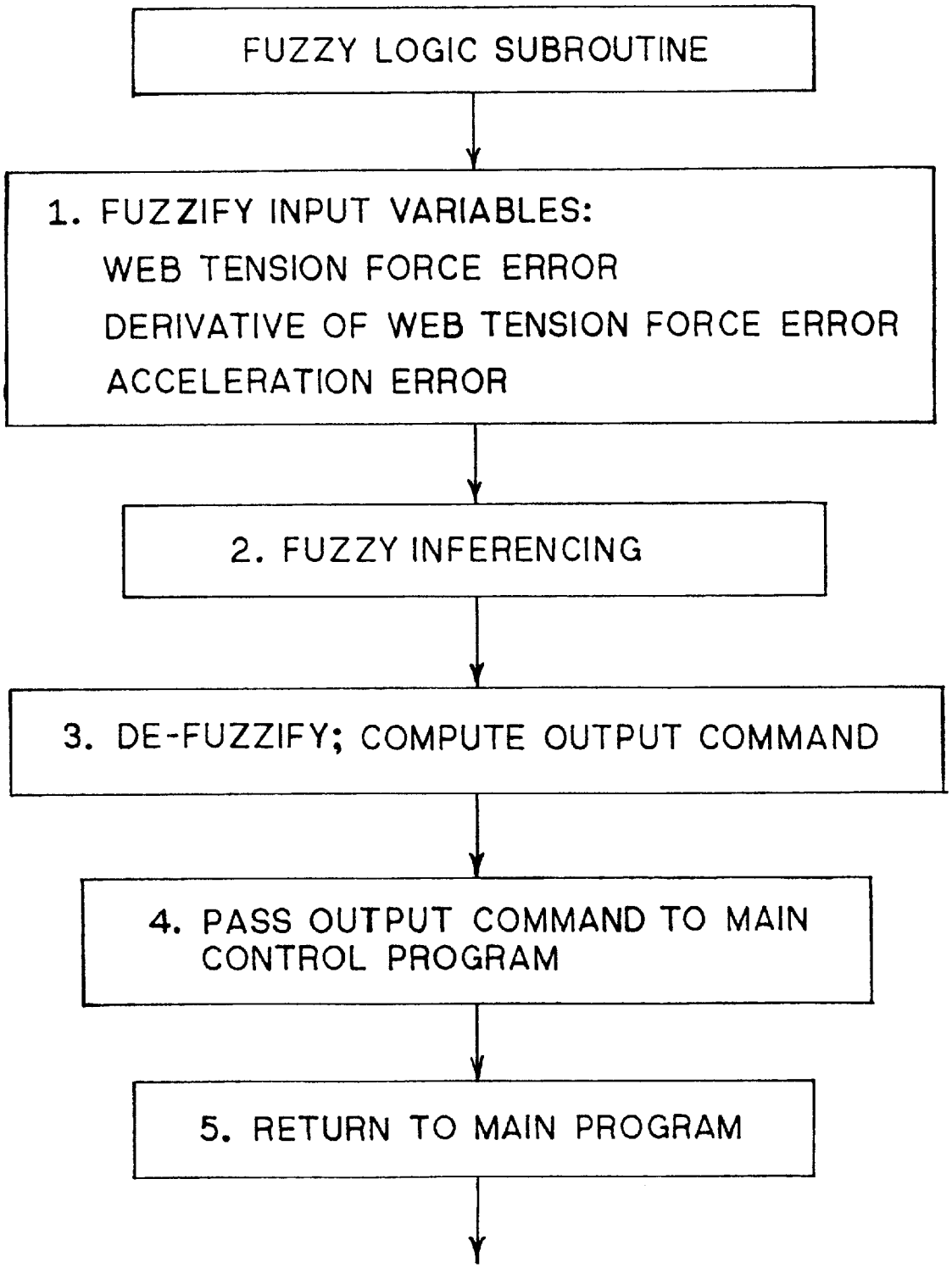
FIG. 13 is a fuzzy logic subroutine for use in the control program flow diagram of FIG. 11.

In step 4, web tension force error, derivative of web tension force error, and dancer acceleration error, as shown in the control block diagram of FIG. 12 enter fuzzy logic control 78. Fuzzy logic control 78 operates the fuzzy logic subroutine shown in FIG. 13.

The fuzzy logic subroutine preferably comprises a computer software program stored in computer controller 70 and executed at the appropriate time with the appropriate error values in step 4 of FIG. 11. As shown in step 1 of FIG. 13, the three variables are input into the fuzzy logic subroutine. Fuzzy inferencing occurs in subroutine step 2. In subroutine step 3, the output is de-fuzzified, and an output command is computed in response to the three input signals. In subroutine step 4, the output command of the fuzzy logic subroutine is sent to the main control program. In subroutine step 5, the subroutine returns to the main program.

Suitable subroutines are generally well known in the signal processing art. Fuzzy logic subroutines are available from Inform Software Corporation of Oak Brook, Ill. and other corporations.

Fuzzy logic control circuits are generally known in the electrical art and explained in detail in the textbook "Fuzzy Logic and NeuroFuzzy Applications Explained" by Constantin von Altrock, published by Prentice Hall. However, to applicants' knowledge, this application contains the only known disclosure of fuzzy logic in a dancer system.

In step 5 of the main control program flow diagram of FIG. 11, the output from the fuzzy logic subroutine is used to compute a target force command $F^*_{servo}$ for actuator apparatus 56.

In step 6, a torque command proportional to $F^*_{servo}$ is sent to actuator apparatus 56 to power dancer roll 24. In step 7, the control program flow diagram of FIG. 11 is repeated and once again the fuzzy logic subroutine executes to generate an output command.

The novel use of fuzzy logic in a dancer system 20, provides superior results and performance when compared to other dancer systems sensing the same variables. Therefore, the fuzzy logic subroutine provides advantages previously unknown and unrecognized in the dancer roll control systems art.

FOURTH EMBODIMENT

Figure 14:
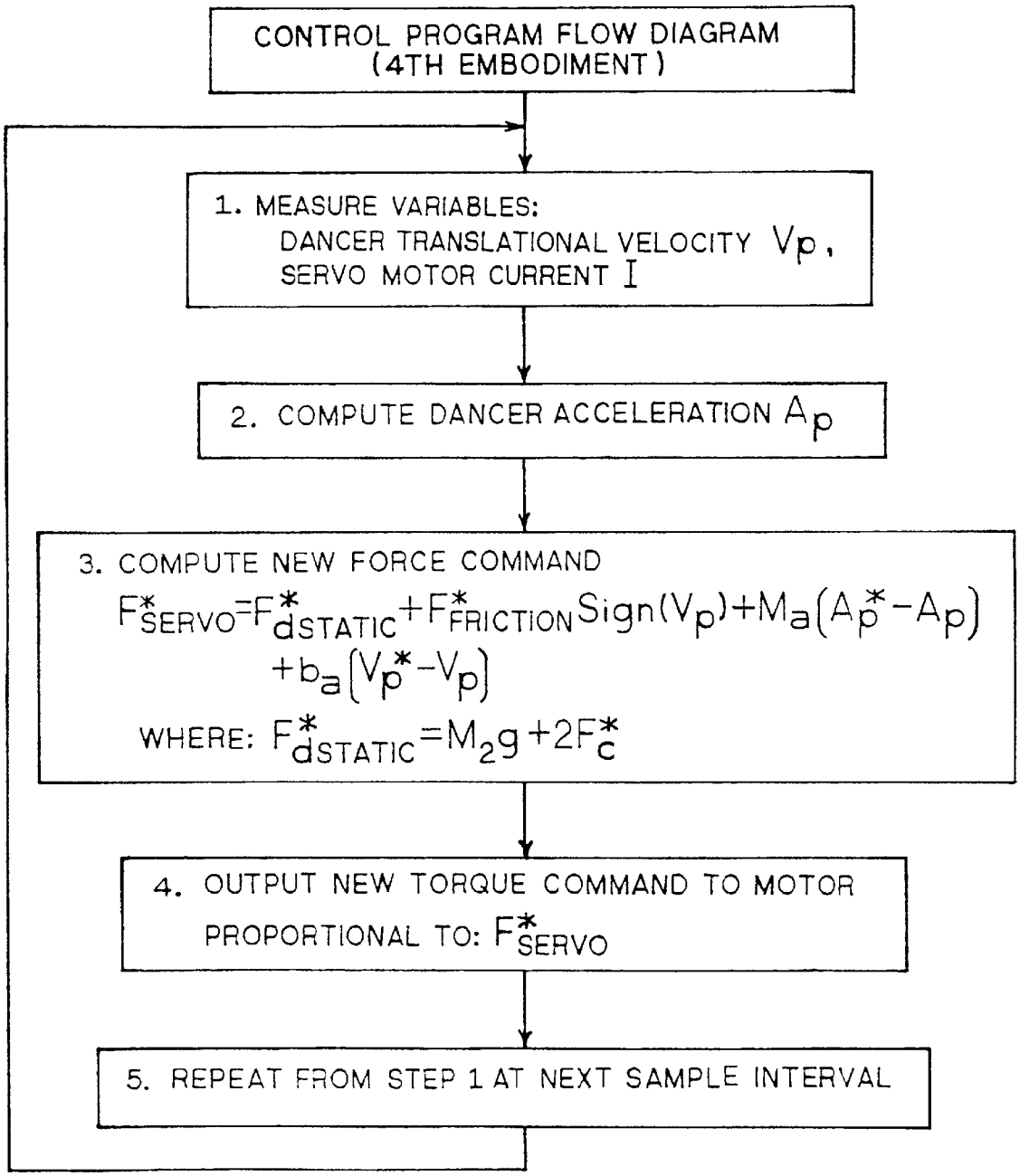
FIG. 14 is a control program flow diagram for a fourth embodiment of the invention.

FIG. 14 shows a control flow program for a fourth embodiment of the invention. In this embodiment, in step 1, the only variables measured or sensed are dancer translational velocity $V_p$ and actuator apparatus or servo motor current I.

In step 2, dancer acceleration $A_{pe}$ can be computed or estimated by an observer using the equation described earlier:

$$A_{pe}=[k_1(V_p-V_{pe})+k_{te}I-F^*_{d\ static}-F^*_{friction}\mathrm{Sign}(V_p)]/M_{2e}$$

Thus estimated dancer acceleration is computed by an observer, as described earlier, using only dancer translational velocity $V_p$ and servo motor current I as measured inputs. All of the other elements are constants or values computed from translational velocity $V_p$.

In step 3, a new force command $F^*_{servo}$ is estimated using the equation shown therein. In step 4 a new output torque command proportional to $F^*_{servo}$ is output to actuator apparatus 56 via zero order hold (ZOH). Actuator apparatus 56, in most embodiments, comprises a servo motor for receiving the servo motor control signal and controlling force applied to dancer roll 24.

Figure 15:
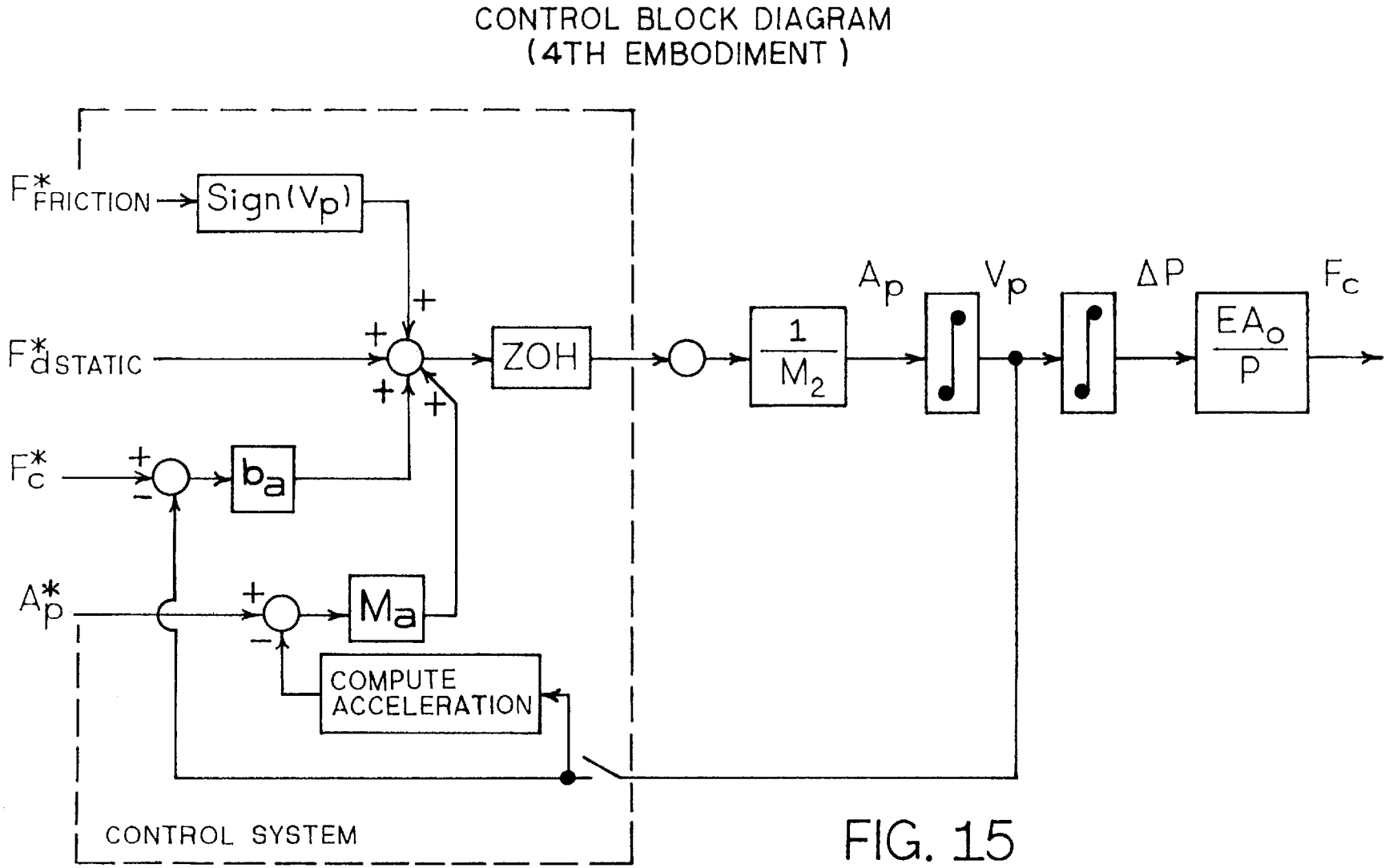
FIG. 15 is a control block diagram for the control flow diagram of FIG. 14.

Using the above values and $A^*_{pe}$, $V^*_{pe}$ computed from $A_{pe}$, $V_p$, and other constants or values shown in the control block diagram of FIG. 15. the embodiment of FIGS. 14 and 15 operates dancer system 20. Such a system actively compensates for coulomb and viscous friction, and also acceleration, to actively cancel the effects of mass. The result is virtually a pure web tensioning force free of dynamic effects from mass and drag. Dancer roll 20 still has polar inertia that is not compensated for, but the polar inertia can be minimized. For instance, the polar inertia can be minimized by decreasing the mass and/or radius of dancer roll 24.

FIFTH EMBODIMENT

The fifth embodiment of the invention comprises an embodiment that uses dancer translational position P to assist in generating force commands for actuator apparatus 56. As shown in step 1 of the control program flow diagram of FIG. 16, dancer translational position P, web tension $F_c$ after dancer roll 24, and actuator apparatus or servo motor current I, are measured or scanned periodically. The measured values are input into computer controller 70.

Figure 16:
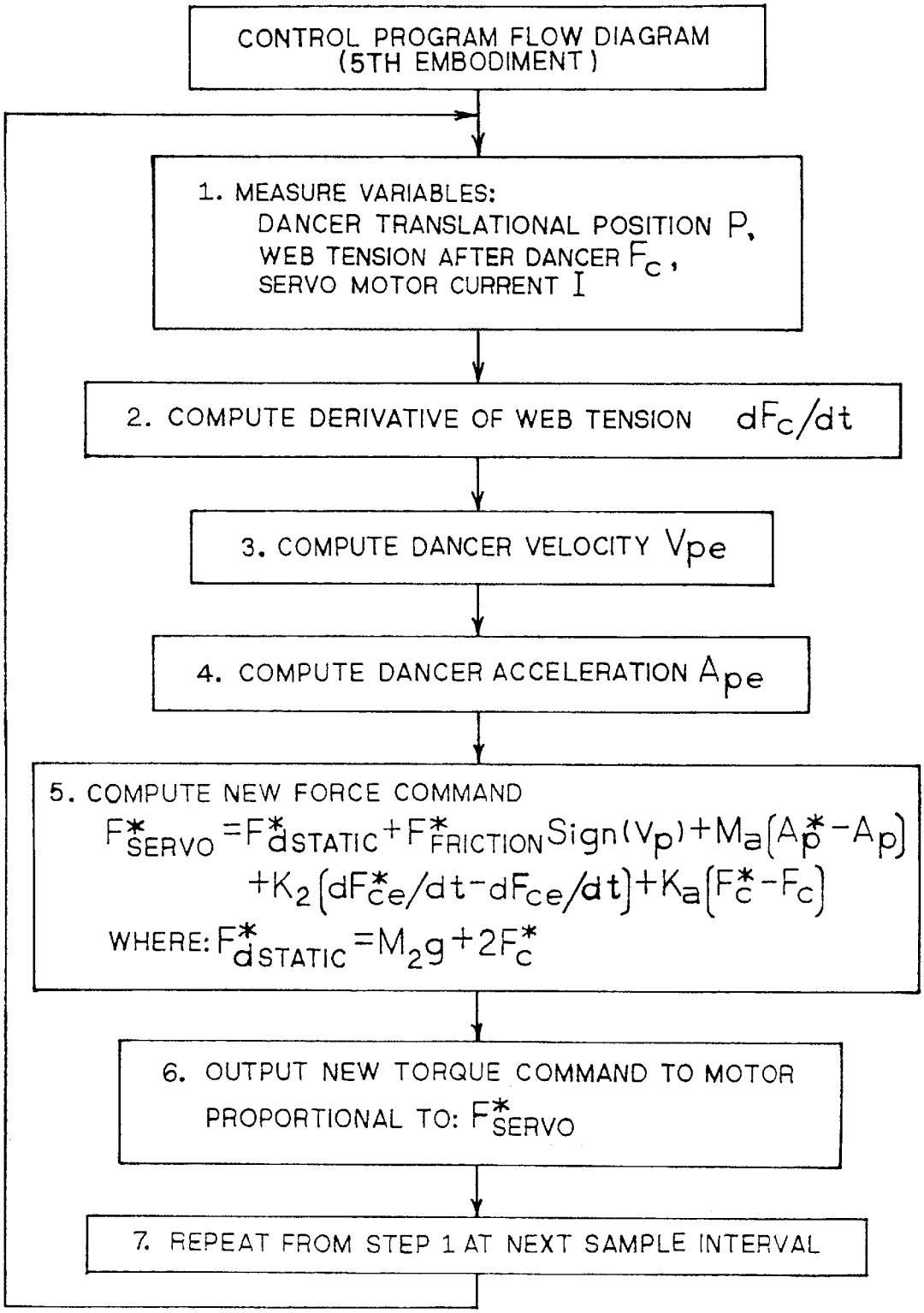
FIG. 16 is a control program flow diagram for a fifth embodiment of the invention.

In step 2 of the diagram of FIG. 16, the measured values are then utilized to compute a derivative of web tension $dF_c/dt$. The derivative of web tension $dF_c/dt$ can be computed or estimated using the present and previous web tensions set forth earlier in the second embodiment.

In step 3, dancer velocity $V_p$ is computed. Such a computation can utilize the change in position P during the time period between scans of the position sensor. Dancer velocity $V_{pe}$ can also be computed using the observer shown in FIG. 17. The observer of FIG. 17 can be a separate physical circuit or can be a model of a computer program set forth in computer controller 70. The observer functions in a similar manner to earlier observers disclosed herein, except position error is multiplied by observer gain $k_3$. The other terms of the equation and relationships therefrom are known from earlier descriptions recited herein. Integration of the estimated translational acceleration $A_{pe}$, in step 4, computes an estimated translational velocity $V_{pe}$. Likewise, integrating the estimated translational velocity $V_{pe}$ generates an estimated translational position P.

In step 5, a force command for actuator apparatus 56 is computed using the equation listed therein and described earlier.

In step 6, a torque command is output to actuator apparatus 56 proportional to $F^*_{servo}$.

In step 7, the above routine of steps is repeated again at a predetermined frequency or scan time.

For use in the force command equation in box 5 of FIG. 16, the value for $A^*_p$ can equal zero, or a value can be computed using an observer as disclosed herein.

Figure 18:
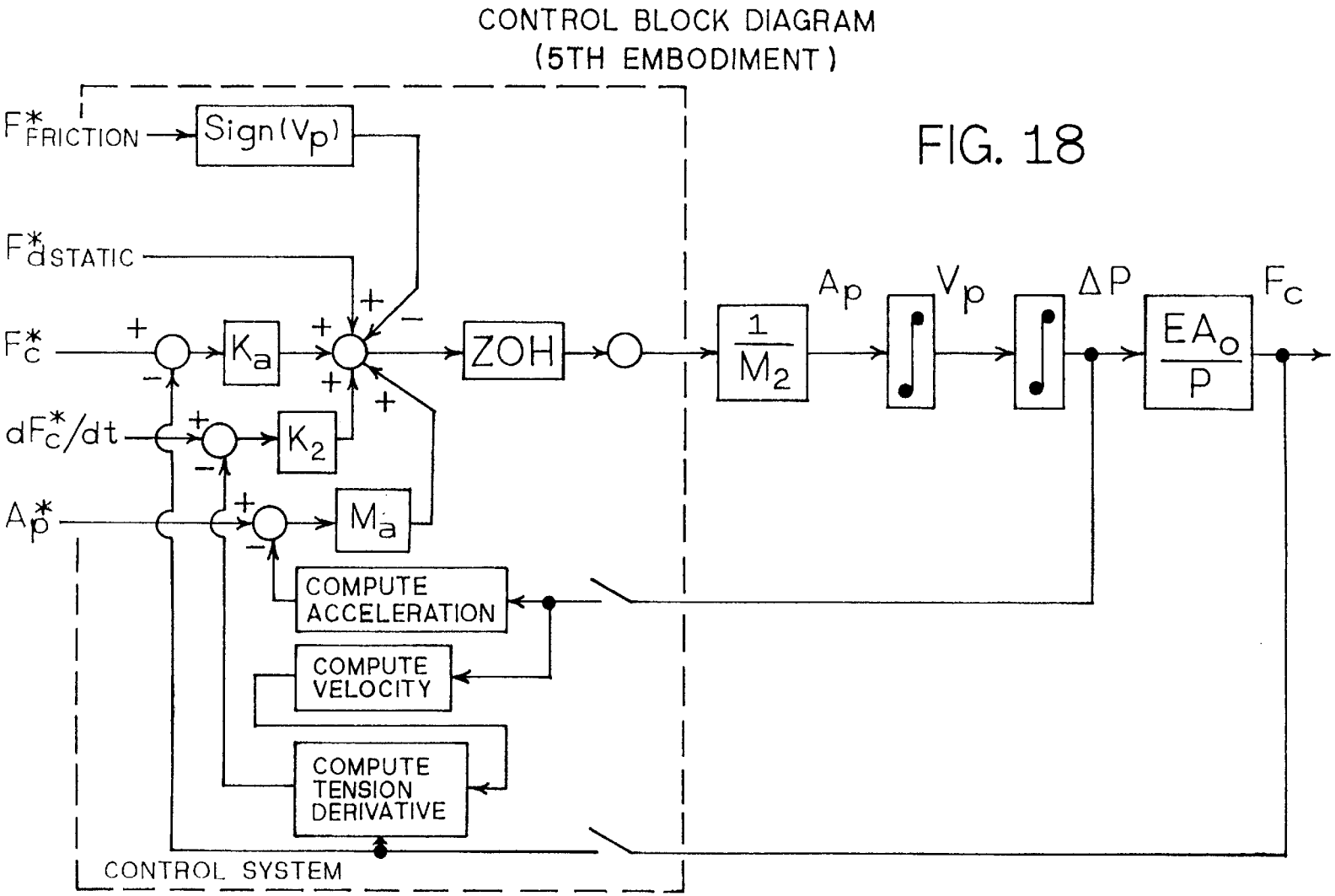
FIG. 18 is a control block diagram for the control program flow diagram of FIG. 16.

FIG. 18 shows a control block diagram corresponding to the control program flow diagram of FIG. 16. The control block diagram shows the operations of the control system and sensors. This fifth embodiment enables computer controller 70 to operate dancer system 20 in an active mode with better results than passive dancer systems or active dancer systems not accounting for acceleration properties.

SIXTH EMBODIMENT

Figure 19:
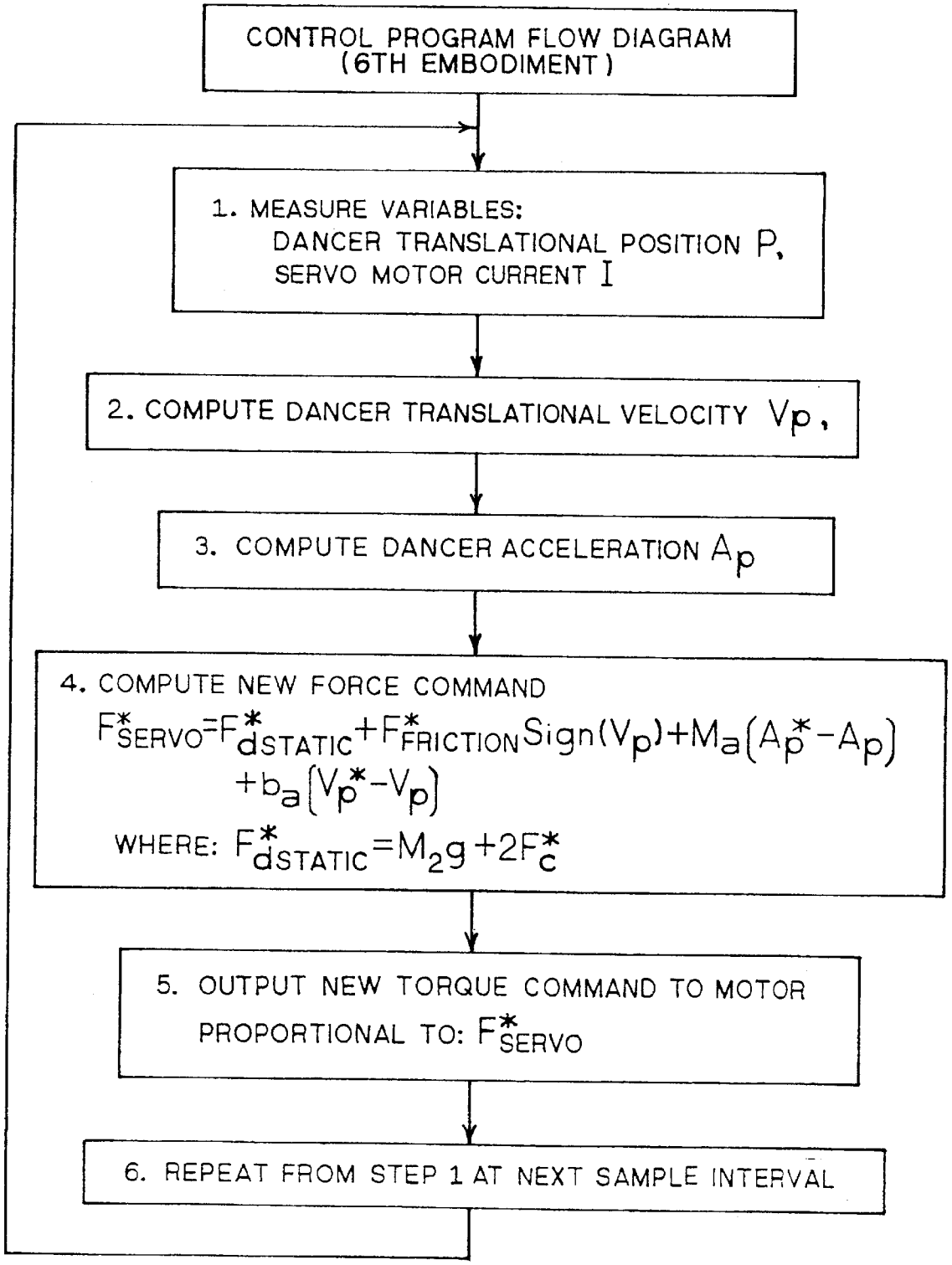
FIG. 19 is a control program flow diagram for a sixth embodiment of the invention.
Figure 20:
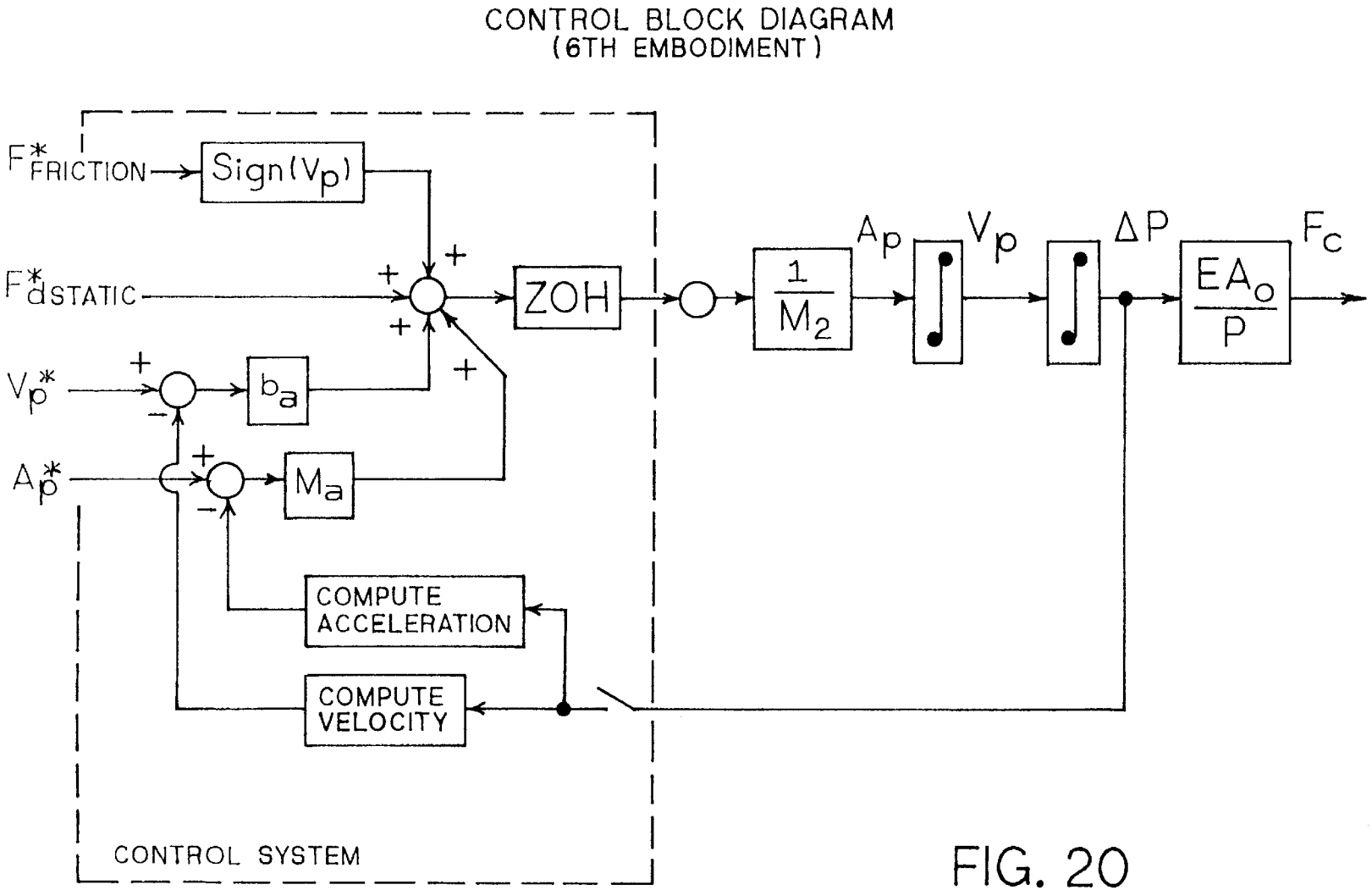
FIG. 20 is a control block diagram for the control program flow diagram of FIG. 19.

FIG. 19 shows Control Flow Program for a sixth embodiment of the invention. In this embodiment, in step 1, the variables measured or sensed are dancer translational position P and actuator apparatus or servo motor current I.

In step 2, dancer translational velocity $V_{pe}$ is computed or estimated using the equation described earlier or the equation:

$$V_{pe}=[P(latest)-P(previous)]/\Delta T$$

Figure 17:
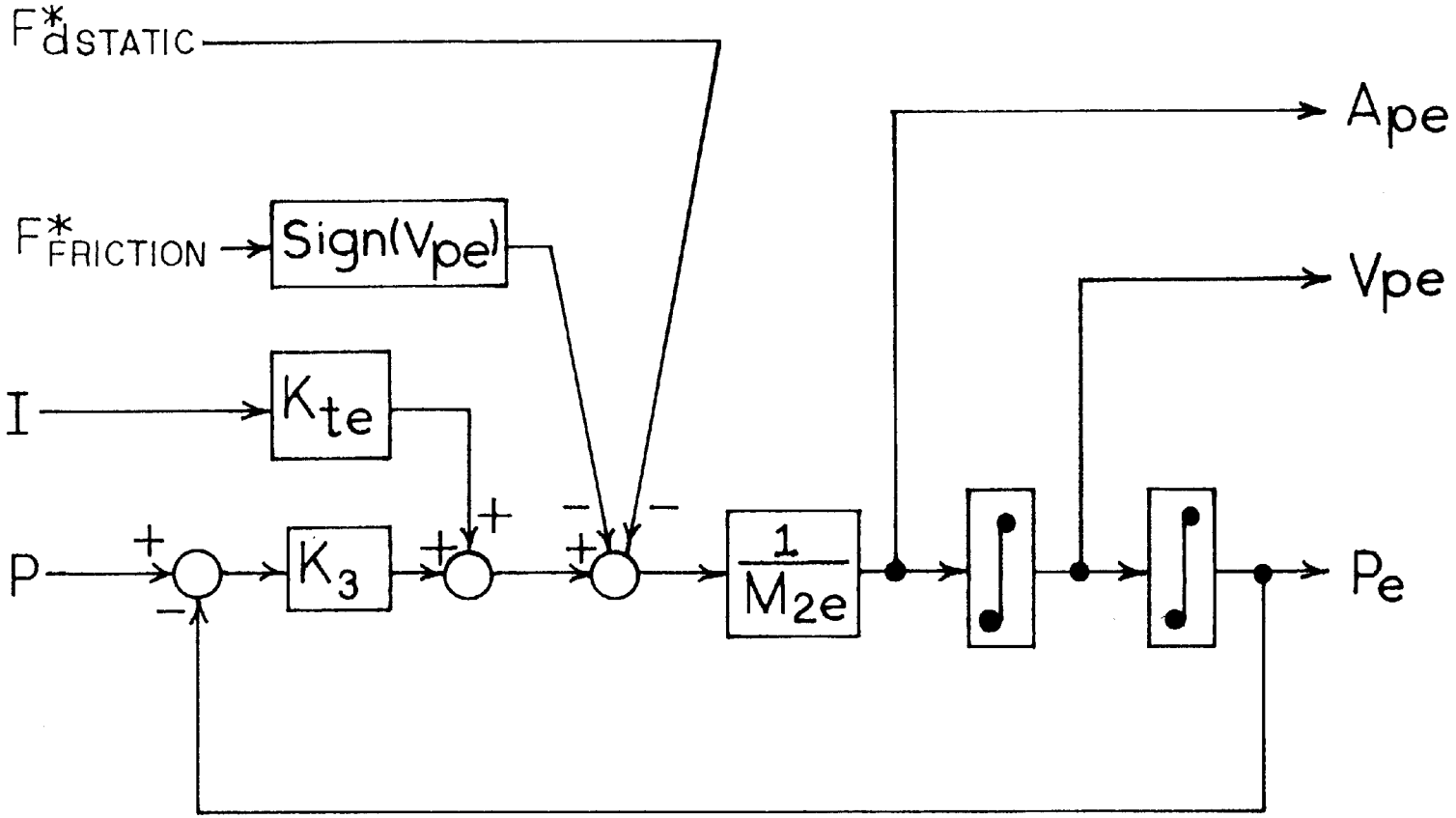
FIG. 17 is a control block diagram for an observer computing translational velocity and acceleration from a sensed position for the embodiment of FIG. 16.

Likewise a target set point for dancer translational velocity $V^*_{pe}$ can also be computed using an observer, as set forth earlier in FIG. 17, in response to actuator apparatus or servo motor current I and position P.

In step 3, dancer translational acceleration $A_p$ can be computed using previously computed values of $V^*_p$ and $V_{pe}$ or other methods including an observer utilizing actuator apparatus or servo motor current I.

In step 4, a new target force command $F^*_{servo}$ is estimated using the equation shown therein. In step 5, a new torque command proportional to $F^*_{servo}$ is output to actuator apparatus 56 via zero order hold (ZOH). Actuator apparatus 56 receives the force signal and controls force applied to dancer roll 24. In step 6, the previous steps are repeated at the next sampling interval.

For use in the force command equation of step 4, the values for $A^*_p$ and $V^*_p$ can be computed by an observer as disclosed herein.

This embodiment has the advantage of requiring sensing of only actuator apparatus current I and dancer translational position P. Thus this embodiment is simpler to operate and maintain than other embodiments having more sensors. Yet this embodiment uses velocity and acceleration to provide improved results over other active dancer systems 20.

SEVENTH EMBODIMENT

Figure 21:
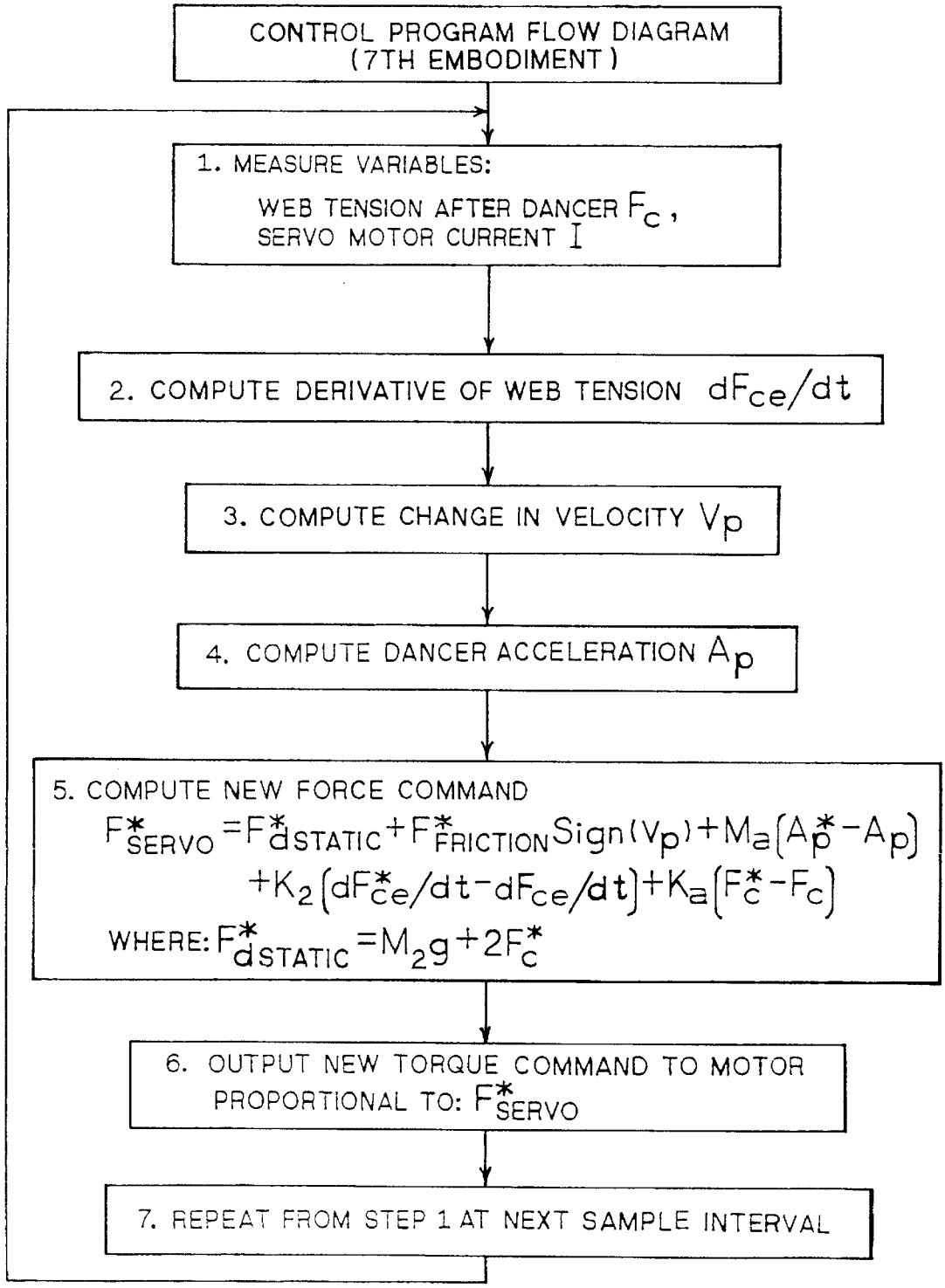
FIG. 21 is a control program flow diagram for a seventh embodiment of the invention.

The seventh embodiment is illustrated in control program flow diagram of FIG. 21. In this embodiment, the web tension $F_c$ and the actuator apparatus or servo motor current I are the only variables measured. This approach is attractive because the measured web tension is the variable that needs to be controlled and thus preferably should be sensed.

Figure 22:
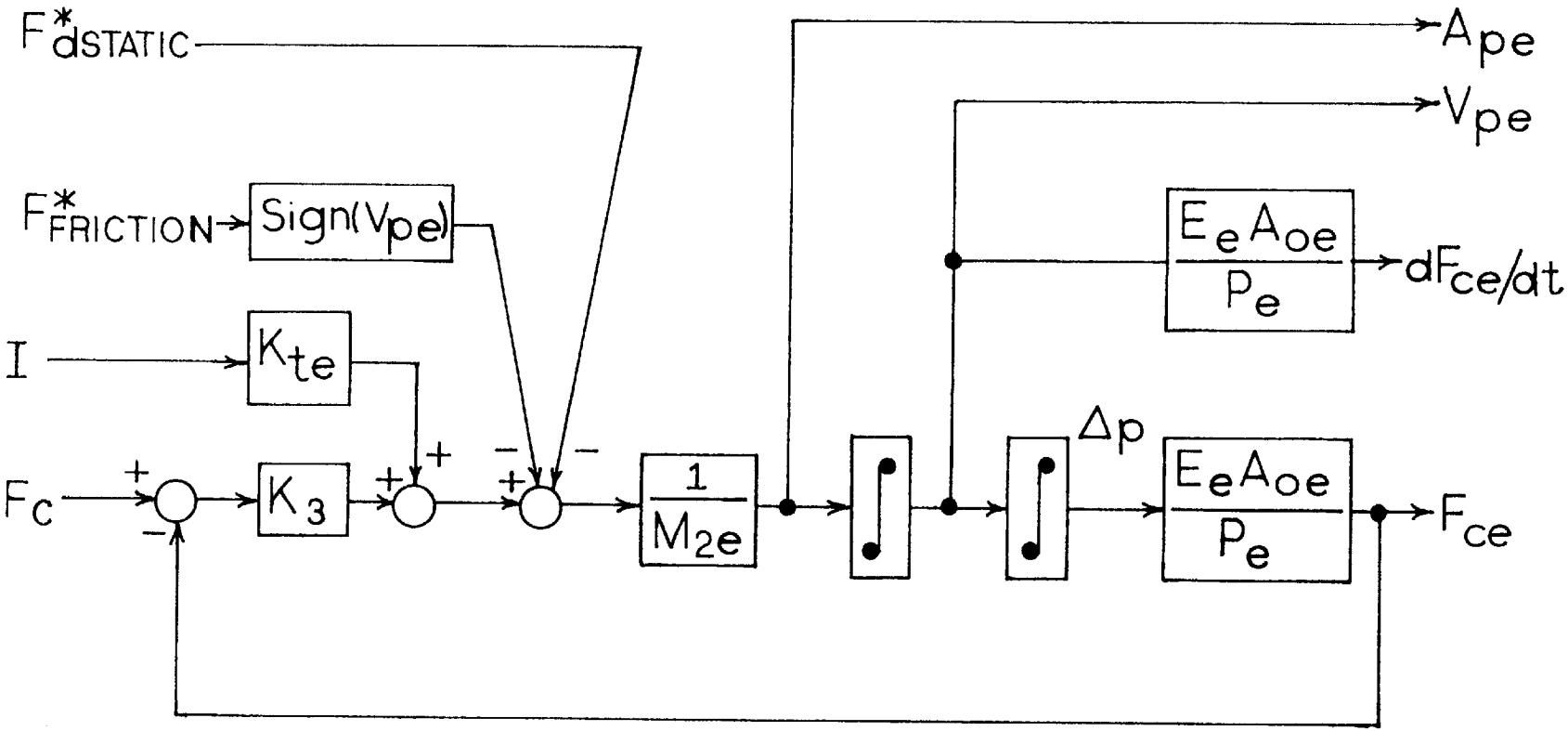
FIG. 22 is a control block diagram for an observer computing web tension derivative, translational velocity and translational acceleration for the embodiment of FIG. 21.

The observer of FIG. 22 comes from the recognition that the web force is related to web deflection which is actually a change in position ΔP. The observer, as in all of the cases described herein, can be thought of as a model of the physical system. The derivative of web force therefore relates to velocity $V_p$, and the second derivative of force relates to acceleration $A_p$.

Observer output Fce corresponds to the actual physically measured state, in this case web tension force $F_c$, that is input to the observer's closed loop controller. The value of the physically measured state is compared to the estimated value and the error gets multiplied by a controller gain $k_3$. The controller gain has no direct physical meaning. However, the controller gain has units of force per unit of error. The entire force, both static and variable force components (as in the earlier embodiments), is divided by an estimate of system mass $M_{2e}$. The result is an estimate of acceleration $A^*_{pe}$. The estimated acceleration gets integrated to yield an estimate of velocity. The estimate of velocity gets integrated to yield an estimate of web deflection. The estimated web deflection gets multiplied by web property estimates to yield the estimated web tension force $F_c$.

This process continues until the closed loop control forces the estimated web tension $F_{ce}$ to converge with the actual measured web tension, $F_c$. The command feed forward portion of the observer improves the observer's accuracy during non-steady state operation. This is so, because the actuator current I is directly related to motor effort, which is directly proportional to acceleration. In this observer, the measured value of actuator current I is multiplied by an estimate of the motor torque constant $K_{te}$ which yields a value proportional to force. This value gets added directly to the force computed in the observer's error section Thus, dynamic accuracy is improved because changes in effort immediately change the web tension estimate, as opposed to waiting for error to accumulate.

In step 1, the web tension Fc and the servo motor current I are measured as described earlier.

In step 2, a derivative of web tension $dF_{ce}/dt$ can be computed as disclosed earlier in the second embodiment. Otherwise, derivative of web tension can be computed using the observer shown in FIG. 22. The observer can be implemented in software in computer 70 or by using operational amplifiers. As shown in FIG. 22, the output force is divided by the estimated physical mass $M_{2e}$ of the system to compute dancer acceleration $A_{pe}$ as required in step 4. Likewise, the acceleration value is integrated by software or an operational amplifier designated by the symbol in FIG. 22 to obtain an estimated velocity as set forth in step 3. Finally the equation:

$$dF_{ce}/dt=V_{pe}[(E_eA_o)/P_e]$$

In this manner, the observer can compute all of the values required, including $F_{ce}$ as illustrated in FIG. 22.

Figure 23:
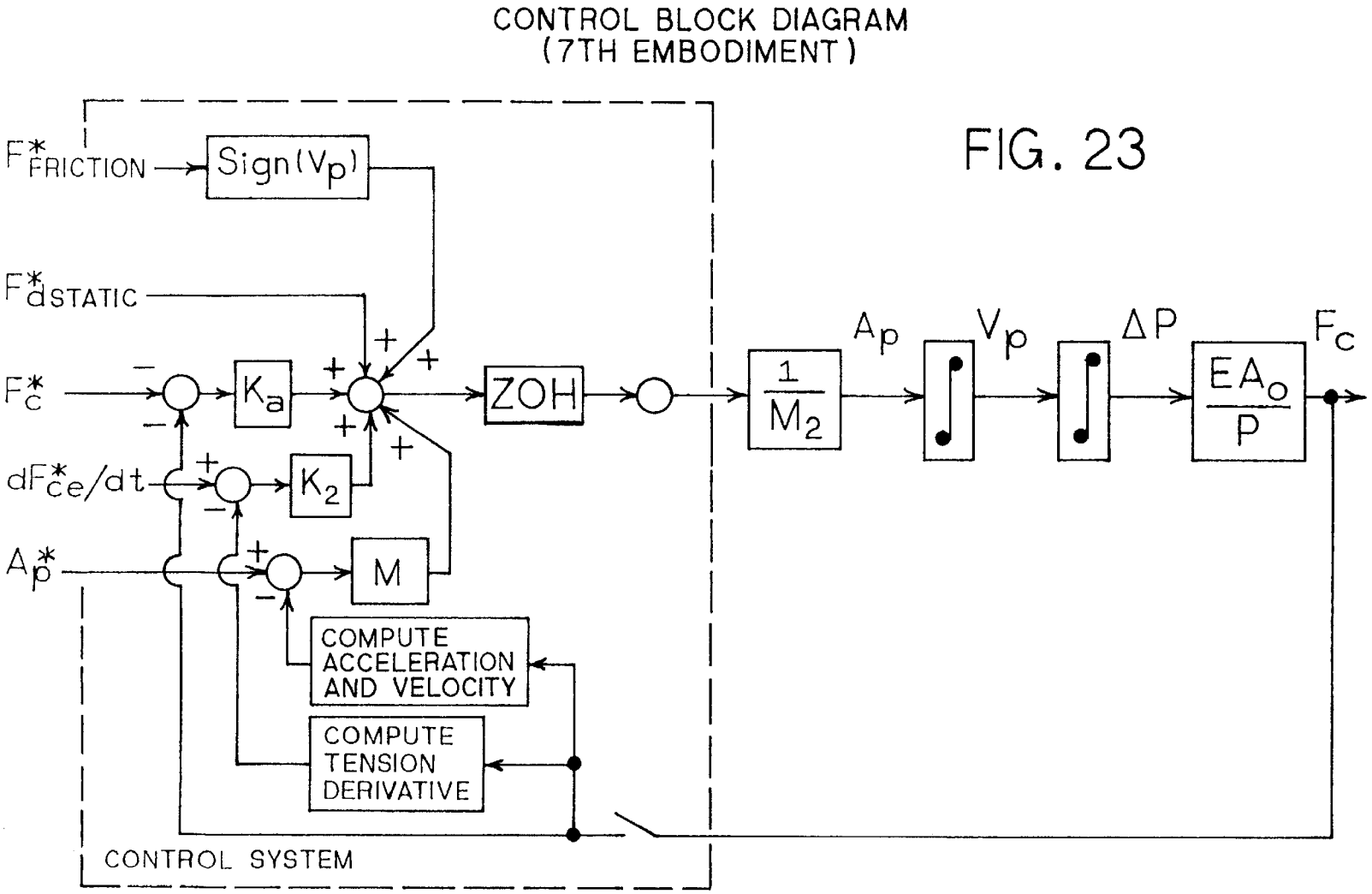
FIG. 23 is a control block diagram for the control program flow diagram of FIG. 21.

In step 5, the equation is solved for $F^*_{servo}$ and in step 6 the force value is applied by actuator apparatus 56 to drive dancer roll 24. Additional variables, as needed, are computed by the methods recited earlier. FIG. 23 illustrates a control block diagram for the control program flow diagram of FIG. 21 and better illustrates many of the values computed, such as $A_{pe}$ and $F_{ce}$.

For use in the force command equation of step 5, the values for $A^*_p$ and $V^*_p$ can be computed by an observer as disclosed earlier herein or preset to zero, if desired.

In step 6, a new torque command proportional to $F^*_{servo}$ is output to actuator apparatus 56 via zero order hold (ZOH).

In step 7, the flow diagram of FIG. 21 is repeated, and sampling of the web tension $F_c$ and the servo motor current I reoccurs. Once again, actuator apparatus 56 readjusts the force $F^*_{servo}$ applied to dancer roll 24 to maintain web tension $F_c$ at a constant value.

In conclusion, the seventh embodiment discloses a dancer system 20 that accounts for velocity and acceleration changes and maintains an improved web tension while only sensing web tension and servo current. Only sensing two variables requires much simpler wiring and other arrangements than, for example, the first embodiment.

EIGHTH EMBODIMENT

Figure 24:
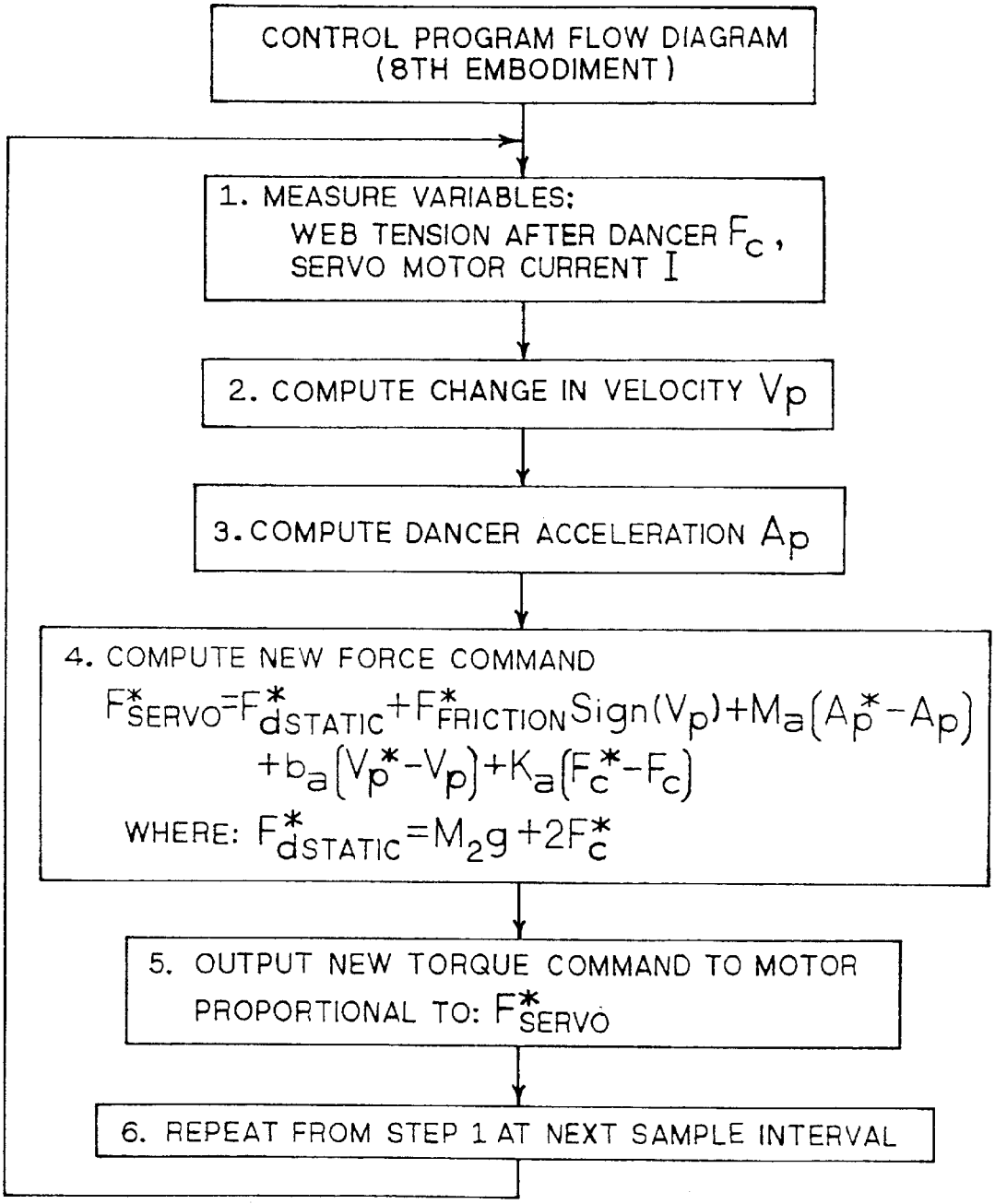
FIG. 24 is a control program flow diagram for an eighth embodiment of the invention.

In the eighth embodiment, as in the seventh embodiment, the only values that need to be measured are web tension Fc after dancer roll 24 and servo-motor current I However, unlike the seventh embodiment, a derivative of force command $F^*_c$ need not be computed. The control program flow diagram of FIG. 24 illustrates operation of dancer system 20 in the eighth embodiment.

In a first step, values for web tension $F_c$ after dancer roll 24 and servomotor current I are measured.

Figure 25:
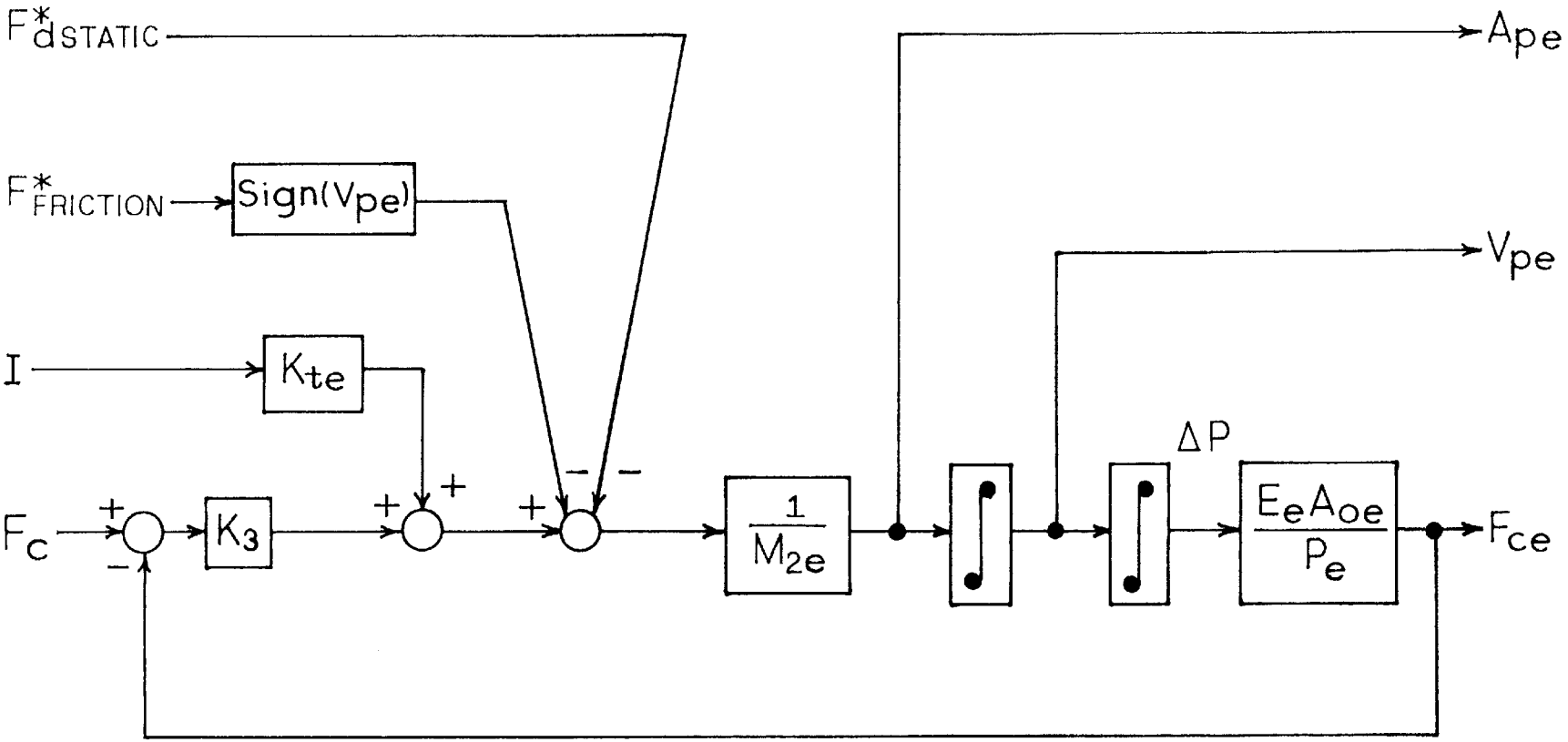
FIG. 25 is a control block diagram for an observer computing dancer translational velocity and acceleration from web tension.

In a second step, an observer, shown in FIG. 25, computes translational velocity $V_{pe}$.

In a third step, the observer computes translational acceleration $A_{pe}$ of dancer roll 24. Of course, the third and second steps can be computed in reverse order. The observer of FIG. 25 functions in a similar manner to the observers described earlier.

In a fourth step, a new force command $F^*_{servo}$ is computed using the earlier computed values as well as the force applied earlier by actuator apparatus 56 and derived from motor current I. The equation for computing force is shown in the block of the fourth step. Further, the control block diagram of FIG. 26 also shows all of the forces applied to dancer system 20.

For use in the force command equation of step 4, the values for $A^*_p$, $F^*_c$, and $V^*_p$ can be computed by an observer as disclosed earlier herein or preset to zero or another preselected value, as needed.

In a fifth step, a new torque command is output to actuator apparatus 56. In a sixth step, the process repeats at the next scan time or interval.

The eighth embodiment recognizes that the web force is related to web deflection which is actually a change in position ΔP. ΔP represents the change in dancer position due to elongation of the web. The derivative of force is therefore related to the web elongation velocity.

The observer operates as a model of dancer system 20 connected to a closed loop controller. Assuming the operating point position P of dancer roll 24 is essentially constant and that the web never goes slack, one can assume that $V_p=\Delta V_p$ (velocity due to elongation of the web) and $A_p=\Delta A_p$ (rate of change of the velocity of the elongation of the web). The output of the model, $F_{ce}$ corresponds to the actual physically measured state, for web tension force, that inputs to the observer's closed loop controller as shown in FIG. 25. The value of the physically measured state $F_c$ is compared to the estimated value and the error gets multiplied by controller gain $k_3$. Controller gain $k_3$ has no direct physical meaning, but does represent units of force per unit of error. As shown in the observer of FIG. 25, the estimated velocity $V_{pe}$ is integrated to yield an estimate of the web deflection ΔP. ΔP is then multiplied by the web properties shown in FIG. 25 to compute an estimated web tension $F_{ce}$. The above steps continue until the closed loop control forces the estimated web tension to converge at the measured web tension. The command feed forward portion of the observer improves the observer's accuracy during non-steady state operation.

Figure 26:
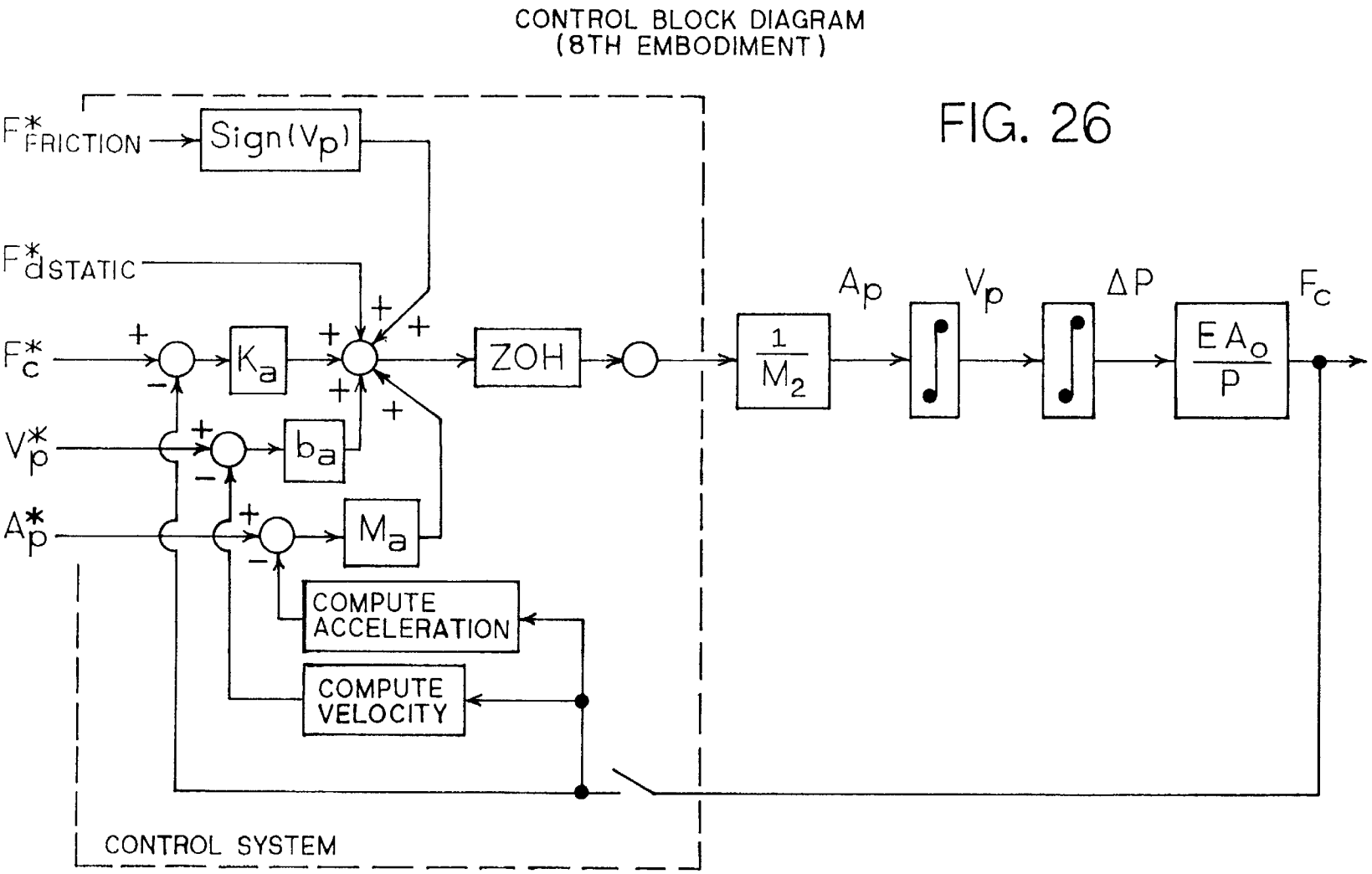
FIG. 26 is a control block diagram for the control program flow diagram of FIG. 24.

Actuator apparatus or motor current I is directly related to motor effort or force applied to dancer roll 24. In the embodiment of FIGS. 24–26, the measured value of motor current is multiplied by an estimate of the motor torque constant $K_{te}$ that yields a value proportional to force. This value gets added directly to the force computed in the observer's error drive section. Command feed forward improves dynamic accuracy because changes in effort or force immediately change the web tension estimate $F_{ce}$, as opposed to waiting for accumulated error to change the estimate. Therefore, command feed forward can be defined as a detected variable immediately being fed to the control variable of interest ($F_{ce}$) to enable fast convergence of the observer system.

NINTH EMBODIMENT

The ninth embodiment measures more variables than the eighth embodiment. However, this embodiment has all of the advantages of the first embodiment with three fewer measured variables. The addition of the specialized state observer of FIG. 25 used in the eighth embodiment, and used here in the ninth embodiment, enables accurate estimation of ΔP, $V_{pe}$, and $A_{pe}$. Therefore, the accuracy of the first embodiment can be substantially maintained with a system having fewer sensors and hardware requirements.

Figure 27:
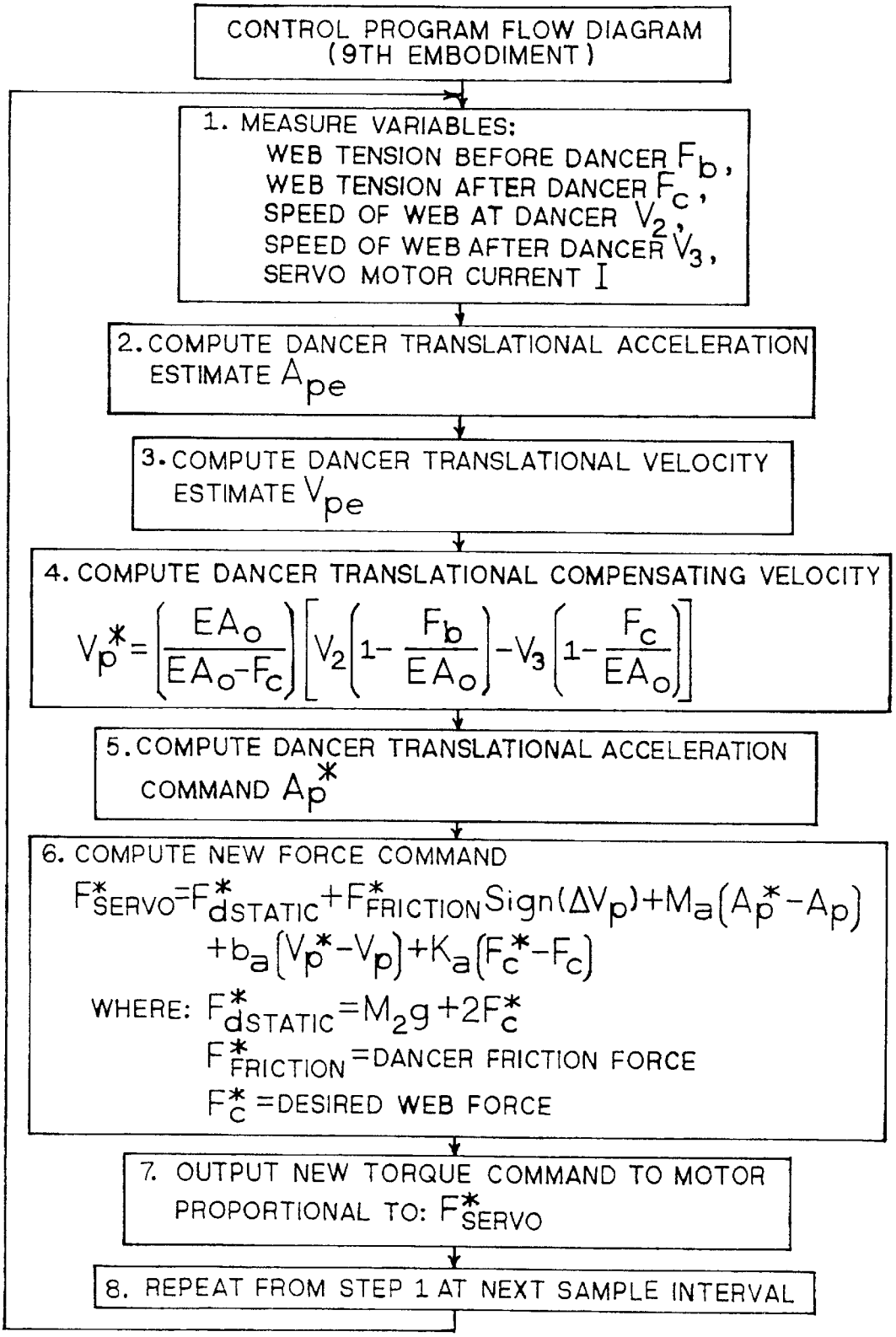
FIG. 27 is a control program flow diagram for a ninth embodiment of the invention.

In a first step shown in the control program flow diagram of FIG. 27, values for web tension $F_b$ before dancer roll 24, web tension $F_c$ after dancer roll 24, web velocity $V_2$, web velocity $V_3$, and actuator or servo-motor current I are measured.

In a second step, the observer, shown in FIG. 25, computes translational acceleration $A_{pe}$.

In a third step, the observer computes translational velocity $V_{pe}$ by integrating the previously computed value for translational acceleration.

In a fourth step, a set point for a desired target translational velocity $V^*_{pe}$ computed using the equation shown in FIG. 27 and including the variables $V_2$, $V_3$, and $F_c$.

In a fifth step, the observer computes a desired target translational acceleration $A_{pe}$ that acts as a set point.

Figure 28:
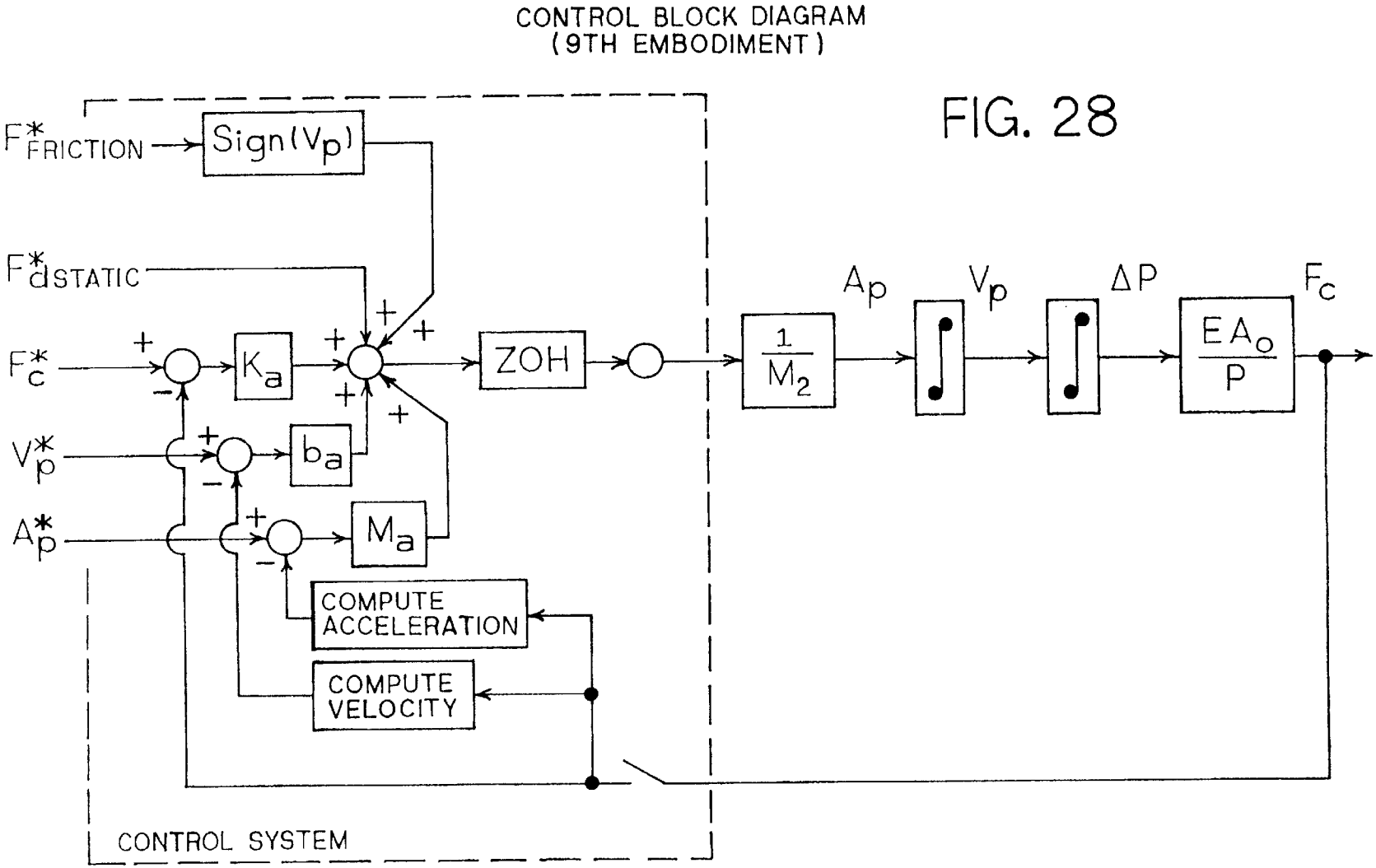
FIG. 28 is a control block diagram for the control program flow diagram of FIG. 27.

In a sixth step, a new force command $F^*_{servo}$ is computed using the earlier computed values as well as the force applied by actuator apparatus 56 and derived from motor current I. The equation for computing force is shown in the block of the sixth step. FIG. 28 illustrates a control block diagram essentially representing the equation in block 6 of FIG. 27.

In a seventh step, a new torque command is output to actuator apparatus 56. In an eighth step, the process repeats at the next scan time or interval.

VARYING TENSION EMBODIMENT

The above described embodiments discuss the use of dancer system 20 with respect to attenuating tension disturbances in the web. In corollary use, dancer system 20 can also be used to intentionally create temporary controlled tension disturbances. For example, in the process of incorporating LYCRA® strands (DuPont Corp. of Delaware) or threads into a garment, e.g. at a nip between an underlying web and an overlying web, it can be advantageous to increase, or decrease, the tension of the LYCRA at specific locations as it is being incorporated into each garment. Dancer system 20 of the invention can effect such short-term variations in the tension in the LYCRA.

Referring to FIG. 2, and assuming LYCRA (not shown) is being added at nip 72, tension on the web can be temporarily reduced or eliminated by inputting a force from actuator apparatus 56 causing a sudden, temporary downward movement of dancer roll 24, followed by a corresponding upward movement of the dancer roll. Similarly, tension can be temporarily increased by inputting a force from actuator apparatus 56 causing a sudden, temporary upward movement of dancer roll 24, followed by a corresponding downward movement. Such a cycle of increasing and decreasing the tension can be repeated more than 200 times, e.g. up to 300 times per minute or more using dancer system 20 of the invention.

For example, to reduce the tension quickly and temporarily to zero, computer controller 70 sends commands, and actuator apparatus 56 acts, to impose a temporary translational motion to dancer roll 24 during the short period over which the tension should be reduced or eliminated. The distance of the sudden translational movement corresponds with the amount of tension relaxation, and the duration of the relaxation. At the appropriate time, dancer roll 24 is again positively raised by actuator apparatus 56 to correspondingly increase the web tension. By such cyclic activity, dancer roll 24 can routinely and intermittently impose alternating higher and lower (e.g. substantially zero) levels of tension on web 18.

All of the embodiments previously disclosed, could be utilized to provide this effect. However, embodiments having a target web tension $F^*_c$ or set point, would be most effective. The desired value for web tension $F^*_c$ can be varied periodically, preferably as part of a timed set pattern, to form pleats as disclosed earlier in the U.S. Patent to Sabee, or to vary the tension of LYCRA at specific locations on web 18.

Those skilled in the art will now see that certain modifications can be made to the invention herein disclosed with respect to the illustrated embodiments, without departing from the spirit of the instant invention. And while the invention has been described above with respect to the preferred embodiments, it will be understood that the invention is adapted to numerous rearrangements, modifications, and alterations, all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

What is claimed is:

1. Processing apparatus for advancing a continuous web of material through a processing step along a given section of the web, the processing apparatus comprising:

(a) a dancer roll operative for controlling tension on the respective section of web;

(b) actuator apparatus for applying a first static force component, to said dancer roll, having a first value and direction, and balancing said dancer roll against static forces and the average dynamic tension in the respective section of the web;

(c) a controller connected to said actuator apparatus, said controller outputting a second variable force component, through said actuator apparatus, effective to control the net actuating force imparted to said dancer roll by said actuator apparatus, and to periodically adjust the value and direction of the second variable force component, each such value and direction of the second variable force component replacing the previous such value and direction of the second variable force component, and acting in combination with the first static force component to impart a target net translational acceleration to said dancer roll, the second variable force component having a second value and direction, modifying the first static force component, such that the net translational acceleration of said dancer roll is controlled by the net actuating force enabling said dancer roll to control the web tension; and (d) apparatus for computing acceleration ($A_p$) of said dancer roll, said controller comprising a computer controller providing control commands to said actuator apparatus based on the computed acceleration of said dancer roll.

2. Processing apparatus as in claim 1, including a sensor for sensing tension in the web after said dancer roll, said controller being adapted to use the sensed tension in computing the value and direction of the second variable force component, and for imparting the computed value and direction through said actuator apparatus to said dancer roll.

3. Processing apparatus as in claim 2, said sensor being effective to sense tension at least 1 time per second, and effective to recompute the value and direction of the second variable force component, thereby to adjust the value and direction of the computed second variable force component at least 1 time per second.

4. Processing apparatus as in claim 2, said sensor being effective to sense tension at least 500 times per second, said controller being effective to recompute the value and direction of the second variable force component, thereby to adjust the value and direction of the computed second variable force component at least 500 times per second, said actuator apparatus being effective to apply the recomputed second variable force component to said dancer roll at least 500 times per second according to the values and directions computed by said controller, thus to control the net translational acceleration.

5. Processing apparatus as in claim 2, said sensor being effective to sense tension at least 1000 times per second, said controller comprising a computer controller effective to recompute the value and direction of the second variable force component and thereby to adjust the value and direction of the computed second variable force component at least 1000 times per second, said actuator apparatus being effective to apply the recomputed second variable force component to said dancer roll at least 1000 times per second according to the values and directions computed by said computer controller, thus to control the net translational acceleration.

6. Processing apparatus as in claim 1, said controller controlling the actuating force imparted to said dancer roll, and thus acceleration of said dancer roll, including compensating for any inertia imbalance of said dancer roll not compensated for by the first static force component.

7. Processing apparatus as in claim 1, including an accelerometer for measuring the translational acceleration of said dancer roll.

8. Processing apparatus as in claim 1, said apparatus for computing the translational acceleration ($A_p$) of said dancer roll comprising an observer.

9. Processing apparatus as in claim 8, said observer comprising a subroutine in said computer program that computes an estimated translational acceleration and an estimated translational velocity for said dancer roll.

10. Processing apparatus as in claim 8, said observer comprising an electrical circuit.

11. Processing apparatus as in claim 1, and further including:

(e) first apparatus for measuring a first velocity of the web after said dancer roll;

(f) second apparatus for measuring a second velocity of the web at said dancer roll;

(g) third apparatus for measuring translational velocity of said dancer roll; and (h) fourth apparatus for sensing the position of said dancer roll.

12. Processing apparatus as in claim 11, and further including:

(i) fifth apparatus for measuring web tension before said dancer roll; and (j) sixth apparatus for measuring web tension after said dancer roll.

13. Processing apparatus as in claim 12, said controller comprising a computer controller computing a force command using the equation:

$$F^*_{servo}=F^*_{d\ static}+F^*_{friction}\mathrm{Sign}(V_p)+b_a(V^*_p-V_p)+k_a(F^*_c-F_c)+M_a(A^*_p-A_p)$$

wherein the dancer translational velocity set-point $V^*_p$ reflects the equation:

$$V^*_p=[EA_o/(EA_o-F_c)][V_2(1-F_b/EA_o)-V_3(1-F_c/EA_o)],$$

to control said actuator apparatus based on the force so calculated, wherein:

$F^*_{d\ static}$=static force component on said dancer roll and is equal to $Mg+2F^*_c$, $F_c$=tension in the web after said dancer roll, $F^*_c$=tension in the web, target set point, per process design parameters, $F_b$=tension in the web ahead of said dancer roll, $F^*_{friction}$=Friction in either direction resisting movement of the dancer roll, $F^*_{servo}$=Force to be applied by said actuator apparatus, $b_a$=control gain constant regarding dancer translational velocity, in Newton seconds/meter, $k_a$=control gain constant regarding web tension, Mg=mass of said dancer roll times gravity, $M_A$=active mass, $M_e$=active mass and physical mass, $V_p$=instantaneous translational velocity of said dancer roll immediately prior to application of the second variable force component, $\mathrm{Sign}(V_p)$=positive or negative value depending on the direction of movement of the dancer roll, $V_2$=velocity of the web at said dancer roll, $V_3$=velocity of the web after said dancer roll, $V^*_p$=reference translational velocity of said dancer roll, set point, r=radius of a respective pulley on said actuator apparatus, E=Modulus of elasticity of the web, $A_o$=cross-sectional area of the unstrained web, $A^*_p$=target translational acceleration of said dancer roll, set point, and $A_p$=translational acceleration of said dancer roll.

14. Processing apparatus as in claim 13, the target acceleration $A^*_p$ being computed using the equation:

$$A^*_p=[V^*_p-V_p]/\Delta T$$

where ΔT=scan time for said computer controller.

15. Processing apparatus as in claim 14, said computer controller providing control commands to said actuator apparatus based on the sensed position of said dancer roll, and the measured web tensions, acceleration and velocities, and thereby controlling the actuating force imparted to said dancer roll by said actuator apparatus to thus maintain a substantially constant web tension.

16. Processing apparatus as in claim 14, said computer controller providing control commands to said actuator apparatus based on the sensed position of said dancer roll, and the measured web tensions, acceleration and velocities, and thereby controlling the actuating force imparted to said dancer roll by said actuator apparatus to provide a predetermined pattern of variations in the web tension.

17. Processing apparatus as in claim 1, and further including:

(e) first apparatus for measuring translational velocity of said dancer roll;

(f) second apparatus for measuring web tension force after said dancer roll; and (g) third apparatus for sensing the current of said actuator apparatus.

18. Processing apparatus as in claim 17, said controller comprising a computer controller computing a derivative of web tension force from the web tension force over the past sensing intervals, and including an observer computing said translational velocity of said dancer roll, and said computer controller computing a derivative of the web tension force.

19. Processing apparatus as in claim 17, including an observer for computing a derivative of web tension force from the web tension force and the translational velocity of said dancer roll.

20. Processing apparatus as in claim 19, said controller comprising a computer controller, said observer comprising a fuzzy logic subroutine stored in said computer controller, said fuzzy logic subroutine inputting web tension force error, the derivative of web tension force error, and acceleration error, the fuzzy logic subroutine proceeding through the step of fuzzy inferencing of the above errors, and de-fuzzifying of inferences to generate a command output signal, said fuzzy logic subroutine being executed during each scan of said sensing apparatus.

21. Processing apparatus as in claim 1, and further including:

(e) first apparatus for measuring translational velocity of said dancer roll; and (f) second apparatus for sensing the current of said actuator apparatus.

22. Processing apparatus as in claim 21, said controller computing the estimated translational acceleration of said dancer roll from the equation:

$$A_{pe}=[k_l(V_p-V_{pe})+k_{te}I-F^*_{d\ static}-F^*_{friction}\mathrm{Sign}(V_p)]/M_{2e}$$

where $A_{pe}$=estimated translational acceleration of said dancer roll, $F^*_{d\ static}$=static force component on said dancer roll and is equal to $Mg+2F^*_c$, $F^*_{friction}$=Friction in either direction resisting movement of the dancer roll, $\mathrm{Sign}(V_p)$=positive or negative value depending on the direction of movement of the dancer roll, $k_l$=Observer gain, $V_p$=instantaneous translational velocity of said dancer roll, $V_{pe}$=estimated translational velocity, $k_{te}$=Servo motor (actuator apparatus) torque constant estimate, I=actuator apparatus current, and $M_{2e}$=Estimated physical mass of the dancer roll.

23. Processing apparatus as in claim 22, said processing apparatus including a zero order hold for storing force values for application to said dancer roll.

24. Processing apparatus as in claim 22, said processing apparatus actively compensating for coulomb and viscous friction, and acceleration, to actively cancel the effects of mass.

25. Processing apparatus as in claim 1, and further including:

(e) first apparatus for measuring translational position of said dancer roll;

(f) second apparatus for measuring web tension force after said dancer roll; and (g) third apparatus for sensing the motor current of said actuator apparatus.

26. Processing apparatus as in claim 25, said controller computing a derivative of web tension from the present measured web tension and the web tension measured in the previous sensing interval.

27. Processing apparatus as in claim 25, including an observer for computing estimated translational velocity and estimated translational acceleration of said dancer roll from the change in position of said dancer roll.

28. Processing apparatus as in claim 1, and further including:

(e) first apparatus for measuring translational position of said dancer roll; and (f) second apparatus for sensing the motor current of said actuator apparatus.

29. Processing apparatus as in claim 28, said controller computing an estimated dancer translational velocity by subtracting the present value for translational position from the previous value for translational position and then dividing by the time interval between sensing of the values.

30. Processing apparatus as in claim 28, including an observer for computing dancer translational acceleration.

31. Processing apparatus as in claim 1, and further including:

(e) first apparatus for measuring web tension $F_c$ after said dancer roll; and (f) second apparatus for sensing the motor current of said actuator apparatus.

32. Processing apparatus as in claim 31, including an observer utilizing the motor current and force on the web, in combination with an estimate of system mass $M_{2e}$, to compute an estimated translational velocity and a derivative of web tension.

33. Processing apparatus as in claim 31, including an observer utilizing the motor current and force on the web, in combination with an estimate of system mass $M_{2e}$, to compute an estimate translational acceleration $A_{pe}$.

34. Processing apparatus as in claim 33, said observer integrating the translational acceleration to compute an estimate of translational velocity $V_{pe}$ and integrating the estimated translational velocity to compute an estimated web tension force $F_{ce}$.

35. Processing apparatus as in claim 34, said observer changing values until the estimated web tension force equals the actual web tension force.

36. Processing apparatus for advancing a continuous web of material through a processing step along a given section of the web, the processing apparatus comprising:

(a) a dancer roll operative for controlling tension on the respective section of web;

(b) actuator apparatus connected to said dancer roll and thereby providing an actuating force to said dancer roll;

(c) first apparatus for measuring a first velocity of the web after said dancer roll;

(d) second apparatus for measuring a second velocity of the web at said dancer roll;

(e) third apparatus for measuring motor current of said actuator apparatus;

(f) fourth apparatus for measuring web tension before said dancer roll;

(g) fifth apparatus for measuring web tension after said dancer roll;

(h) sixth apparatus for measuring acceleration of said dancer roll; and (i) a controller for providing force control commands to said actuator apparatus based on the above measured values, including computed acceleration $A^*_p$ of said dancer roll, said controller thereby controlling the actuating force imparted to said dancer roll by said actuator apparatus to control the web tension.

37. Processing apparatus as in claim 36, including (j) seventh apparatus for measuring translational velocity of said dancer roll; and (k) eighth apparatus for sensing the position of said dancer roll.

38. Processing apparatus as in claim 37, said controller comprising a computer controller being effective to compute a control force command using the equation:

$$F^*_{servo}=F^*_{d\ static}+F^*_{friction}\mathrm{Sign}(V_p)+b_a(V^*_p-V_p)+k_a(F^*_c-F_c)+M_a(A^*_p-A_p),$$

wherein the dancer translational velocity set-point $V^*_p$ reflects the equation:

$$V^*_p=[EA_o/(EA_o-F_c)][V_2(1-F_b/EA_o)-V_3(1-F_c/EA_o)],$$

and to control said actuator apparatus based on the force so computed wherein:

$F^*_{d\ static}$=static force component on said dancer roll and is equal to $Mg+2F^*_c$, $F^*_{friction}$=Friction in either direction resisting movement of the dancer roll, $F^*_{servo}$=Target force to be applied by said actuator apparatus, $F_c$=tension in the web after said dancer roll, $F^*_c$=target tension in the web, set point, $F_b$=tension in the web ahead of said dancer roll, $b_a$=control gain constant re dancer translational velocity, in Newton seconds/meter, $k_a$=control gain constant re web tension, Mg=mass of said dancer roll times gravity, $M_A$=active mass, $M_e$=active mass and physical mass, $V_p$=instantaneous translational velocity of said dancer roll immediately prior to application of the second variable force component, $\mathrm{Sign}(V_p)$=positive or negative value depending on the direction of movement of the dancer roll, $V_2$=velocity of the web at said dancer roll, $V_3$=velocity of the web after said dancer roll, $V^*_p$=reference translational velocity of said dancer roll, set point, r=radius of a respective pulley on said actuator apparatus, E=Modulus of elasticity of the web, $A_o$=cross-sectional area of the unstrained web, $A^*_p$=reference translational acceleration of said dancer roll, set point, and $A_p$=translational acceleration of said dancer roll.

39. Processing apparatus as in claim 38, the target acceleration $A^*_p$ being computed using the equation:

$$A^*_p=[V^*_p=V_p]/\Delta T$$

where $\Delta T$=scan time or interval for said computer controller.

40. Processing apparatus as in claim 39, said controller being effective to provide control commands to said actuator apparatus at a frequency of at least 1 time per second.

41. Processing apparatus as in claim 39, said controller being effective to provide control commands to said actuator apparatus at a frequency of at least 500 times per second.

42. Processing apparatus as in claim 39, said controller comprising a computer controller effective to provide control commands to said actuator apparatus at a frequency of at least 1000 times per second.

43. Processing apparatus as in claim 36, said controller providing the control commands to said actuator apparatus thereby controlling the actuating force imparted to said dancer roll by said actuator apparatus, and thus controlling acceleration of said dancer roll, such that said actuator apparatus maintains inertial compensation for said dancer system.

44. Processing apparatus as in claim 36, said processing apparatus including a wind-up roll downstream from said dancer roll and driving rolls forming a nip upstream from said dancer roll, said controller sending control signals to said wind-up roll and said driving rolls.

45. Processing apparatus as in claim 37, said eighth apparatus comprising an accelerometer secured to a drive element driving said dancer roll, to thereby move translationally with said dancer roll to measure acceleration thereof.

46. Processing apparatus as in claim 36, including an observer computing translational acceleration $A_{pe}$ and integrating the translational acceleration to compute translational velocity $V_{pe}$ of said dancer roll.

47. Processing apparatus as in claim 46, said controller comprising a computer controller computing a velocity command $V^*_p$ using the first and second sensed velocities and the web tension before and after said dancer roll.

48. Processing apparatus as in claim 36, said controller comprising a computer controller intentionally periodically varying the force component to unbalance the system, and thus the tension on the web by periodically inputting a command force from said actuator apparatus causing a sudden, temporary upward movement of said dancer roll, followed by a corresponding downward movement such that said dancer roll intermittently imposes alternating higher and lower levels of tension on the web.

49. Processing apparatus as in claim 48, the periodic input of force causing the upward movement of said dancer roll being repeated more than 200 times per minute.

50. In a processing operation wherein a continuous web of material is advanced through a processing step, a method of controlling the tension in the respective section of web, comprising:

(a) providing a dancer roll operative on the respective section of web;

(b) applying a first generally static force component to the dancer roll, the first generally static force component having a first value and direction;

(c) applying a second variable force component to the dancer roll, the second variable force component having a second value and direction, modifying the first generally static force component, and thereby modifying (i) the effect of the first generally static force component on the dancer roll and (ii) corresponding translational acceleration of the dancer roll; and (d) adjusting the value and direction of the second variable force component repeatedly, each such adjusted value and direction of the second variable force component (i) replacing the previous such value and direction of the second variable force component and (ii) acting in combination with the first static force component to provide a target net translational acceleration to the dancer roll.

51. A method as in claim 50, including adjusting the value and direction of the second variable force component at least 500 times per second.

52. A method as in claim 50, including sensing tension in the web after the dancer roll, and using the sensed tension to compute the value and direction of the second variable force component.

53. A method as in claim 50, including sensing tension in the respective section of the web at least 1 time per second, recomputing the value and direction of the second variable force component and thereby adjusting the value and direction of the computed second variable force component at least 1 time per second, and applying the recomputed value and direction to the dancer roll at least 1 time per second.

54. A method as in claim 50 wherein the first and second force components are applied simultaneously to the dancer roll as a single force, by an actuator apparatus.

55. A method as in claim 50 wherein the force components and target net translational acceleration are adjusted such that the tension in the web maintains an average dynamic tension throughout the processing operation while controlling translational acceleration such that system effective mass equals the dancer rolls polar inertia divided by the rolls outer radius squared.

56. A method as in claim 50, wherein the force components and target net translational acceleration are periodically adjusted to intentionally unbalance the dancer roll such that the tension in the dancer roll moves through a sudden, temporary upward movement, followed by a corresponding downward movement, to intermittently impose alternating higher and lower levels of tension on the web.

57. A method as in claim 56, the periodic input of force causing the upward movement of the dancer roll to be repeated more than 200 times per minute.

58. A method as in claim 50 wherein the first and second force components are applied simultaneously to the dancer roll as a single force, by an actuator apparatus, and wherein the step of applying a force to the dancer roll includes:

(a) measuring a first velocity of the web after the dancer roll;

(b) measuring a second velocity of the web at the dancer roll;

(c) measuring translational velocity of the dancer roll; and (d) sensing the position of the dancer roll.

59. A method as in claim 58 wherein the step of applying a force to the dancer roll further includes:

(e) measuring web tension before the dancer roll; and (f) measuring web tension after the dancer roll.

60. A method as in claim 59 wherein the step of applying a force to the dancer roll is computed using the equation:

$$F^*_{servo}=F^*_{d\ static}+F^*_{friction}\mathrm{Sign}(V_p)+b_a(V^*_p-V_p)+k_a(F^*_c-F_c)+M_a(A^*_p-A_p)$$

wherein:

$F^*_{d\ static}$=static force component on said dancer roll and is equal to $Mg+2F^*_c$.

$F^*_{friction}$=Friction in either direction resisting movement of the dancer roll, $F_c$=tension in the web after said dancer roll, $F^*_c$=tension in the web, target set point, per process design parameters, $F^*_{servo}$=Force generated by the actuator apparatus, $b_a$=control gain constant regarding dancer translational velocity, in Newton seconds/meter, $k_a$=control gain constant regarding web tension, Mg=mass of said dancer roll times gravity, $M_A$=active mass, $M_e$=active mass and physical mass, $V_p$=instantaneous translational velocity of said dancer roll immediately prior to application of the second variable force component, Sign($V_p$)=positive or negative value depending on the direction of movement of the dancer roll, $A^*_p$=reference translational acceleration of said dancer roll, set point, $A_p$=translational acceleration of said dancer roll, and wherein the dancer translational velocity set-point $V^*_p$ reflects the equation:

$$V^*_p=[EA_o/(EA_o-F_c)][V_2(1-F_b/EA_o)-V_3(1-F_c/EA_o)],$$

to control the actuator apparatus based on the force so computed, wherein:

$F_b$=tension in the web ahead of said dancer roll, $V_2$=velocity of the web at said dancer roll, $V_3$=velocity of the web after said dancer roll, $V^*_p$=reference translational velocity of said dancer roll, set point, r=radius of a respective pulley on said actuator apparatus, E=Modulus of elasticity of the web, and $A_o$=cross-sectional area of the unstrained web.

61. A method as in claim 60, the target acceleration $A^*_p$ being computed using the equation:

$$A^*_p=[V^*_p-V_p]/\Delta T$$

where ΔT=scan time, the computations being repeated and the force adjusted at least 1 time per second.

62. A method as in claim 50 wherein the first and second force components are applied simultaneously to the dancer roll as a single force, and wherein applying a force to the dancer roll includes:

(a) measuring translational velocity of said dancer roll;

(b) measuring web tension force after said dancer roll; and (c) sensing the current of said actuator apparatus, measuring and sensing occurring during periodic sensing intervals.

63. A method as in claim 62 wherein applying a force to the dancer roll includes:

(a) computing a derivative of web tension force from the web tension force from present and past sensing intervals;

(b) computing the translational velocity of the dancer roll; and (c) computing a derivative of the web tension force.

64. A method as in claim 62, wherein applying a force to the dancer roll includes executing a fuzzy logic subroutine by inputting web tension force error, the derivative of web tension force error, and acceleration error, the fuzzy logic subroutine proceeding through the step of fuzzy inferencing of the above errors, and de-fuzzifying inferences to generate a command output signal, the fuzzy logic subroutine being executed during each of the measuring and sensing intervals.

65. A method as in claim 50 wherein the first and second force components are applied simultaneously to the dancer roll as a single force, and wherein applying a force to the dancer roll includes:

(a) measuring the translational velocity of the dancer roll; and (b) sensing the current of an actuator apparatus.

66. A method as in claim 65, including computing the estimated translational acceleration of the dancer roll from the equation:

$$A_{pe}=[F^*_{d\ static}+F^*_{friction}\mathrm{Sign}(V_p)+k_1(V_p-V_{pe})+k_{te}I]/M_{2e}$$

where:

$A_{pe}$=estimated translational acceleration of said dancer roll, $F^*_{d\ static}$=static force component on said dancer roll and is equal to Mg+2$F^*_c$, $F^*_{friction}$=Friction in either direction resisting movement of the dancer roll, Sign($V_p$)=positive or negative value depending on the direction of movement of the dancer roll, $k_l$=Observer gain, $V_p$=instantaneous translational velocity of said dancer roll, $V_{pe}$=estimated translational velocity, $k_{te}$=Servo motor (actuator apparatus) torque constant estimate, I=actuator apparatus current, and $M_{2e}$=Estimated physical mass of the dancer roll.

67. A method as in claim 50 wherein the first and second force components are applied simultaneously to the dancer roll as a single force, and wherein applying a force to the dancer roll includes:

(a) measuring the translational position of the dancer roll;

(b) measuring web tension force after the dancer roll; and (c) sensing the motor current of an actuator apparatus applying the force to the dancer roll, the above measuring and sensing occurring at each sensing interval.

68. A method as in claim 67, including computing a derivative of web tension from the present measured web tension and the web tension measured in the previous sensing interval.

69. A method as in claim 67, including computing estimated translational velocity and estimated translational acceleration of dancer roll from the change in position of the dancer roll.

70. A method as in claim 50 wherein the first and second force components are applied simultaneously to the dancer roll as a single force, and wherein applying a force to the dancer roll includes:

(a) measuring the translational position of the dancer roll; and (b) sensing the motor current of an actuator apparatus applying the force to the dancer roll.

71. A method as in claim 70, including computing an estimated dancer translational velocity by subtracting the previous sensed value for translational position from the present sensed value of translational position and then dividing by the time interval between sensing of the values.

72. A method as in claim 71, including computing a new force command for application to the actuator apparatus in response to the earlier computed values.

73. A method as in claim 50 wherein the first and second force components are applied simultaneously to the dancer roll as a single force, and wherein applying a force to the dancer roll includes:

(a) measuring web tension $F_c$ after the dancer roll; and (b) sensing motor current of an actuator apparatus.

74. A method as in claim 73, including utilizing the motor current and force on the web, in combination, with an estimate of system mass $M_{2e}$, to compute an estimated translational velocity and a derivative of web tension.

75. A method as in claim 73, including utilizing the motor current and force on the web, in combination with an estimate of system mass $M_{2e}$, to compute an estimate of translational acceleration $A_{pe}$.

76. A method as in claim 75, including integrating the translational acceleration to compute an estimate of translational velocity $V_{pe}$ and integrating the estimated translational velocity to compute an estimated web tension force $F_{ce}$.

77. In a processing operation wherein a continuous web of material is advanced through a processing step, a method of controlling the tension in the respective section of the web, comprising:

(a) providing a dancer roll operative for controlling tension on the respective section of web;

(b) providing actuator apparatus to apply an actuating force to the dancer roll;

(c) measuring a first velocity of the web after the dancer roll;

(d) measuring a second velocity of the web at the dancer roll;

(e) measuring motor current of the actuator apparatus;

(f) measuring web tension before the dancer roll;

(g) measuring web tension after the dancer roll; and (h) providing force control commands to the actuator apparatus based on the above measured values, including computed acceleration $A^*_p$ of the dancer roll, to thereby control the actuating force imparted to the dancer roll by the actuator apparatus to control the web tension.

78. A method as in claim 77, including:

(i) measuring translational velocity of the dancer roll;

(j) sensing the position of the dancer roll; and (k) measuring acceleration of the dancer roll.

79. A method as in claim 78, providing force control commands the actuator apparatus being on the equation:

$$F^*_{servo}=F^*_{d\ static}+F^*_{friction}\mathrm{Sign}(V_p)+b_a(V^*_p-V_p)+k_a(F^*_c-F_c)+M_a(A^*_p-A_p),$$

wherein the dancer translational velocity set-point $V^*_p$ reflects the equation:

$$V^*_p=[EA_o/(EA_o-F_c)][V_2(1-F_b/EA_o)-V_3(1-F_c/EA_o)],$$

to control the actuator apparatus based on the force so calculated wherein:

$F^*_{d\ static}$–static force component on the dancer roll and is equal to $Mg+2F^*_c$, $F^*_{frictio}$=Friction in either direction resisting movement of the dancer roll, $F^*_{servo}$=Target force to be applied by the actuator apparatus, $F_c$=tension in the web after the dancer roll, $F^*_c$=target tension in the web, set point, $F_b$=tension in the web ahead of the dancer roll, $b_a$=control gain constant re dancer translational velocity, in Newton seconds/meter, $k_a$=control gain constant re web tension, Mg=mass of the dancer roll times gravity, $M_A$=active mass, $M_e$–active mass and physical mass, $V_p$ instantaneous translational velocity of the dancer roll, $\mathrm{Sign}(V_p)$=positive or negative value depending on the direction of movement of the dancer roll, $V_2$=velocity of the web at the dancer roll $V_3$=velocity of the web after the dancer roll, $V^*_p$=target translational velocity of the dancer roll, set point, r=radius of a respective pulley on the actuator apparatus, E=Modulus of elasticity of the web, $A_o$=cross-sectional area of the unstrained web, $A^*_p$=target translational acceleration of the dancer roll, set point, and $A_p$=translational acceleration of said dancer roll.

80. A method as in claim 79, the target acceleration $A^*_p$ being computed using the equation:

$$A^*_p=[V^*_p-V_p]/\Delta T$$

where $\Delta T$=scan time or interval between sensing of translational velocity.

81. A method as in claim 80, the interval between sensing of translational velocity being at a frequency of at least 1 time per second.

82. A method as in claim 77, the force control commands to the actuator apparatus controlling acceleration of the dancer roll. such that the actuator apparatus maintains inertial compensation for said dancer system.

83. A method as in claim 77, the method including the steps of sending control signals to an unwind-up roll upstream from the dancer roll.

84. A method as in claim 77, including:

(i) computing translational acceleration $A_{pe}$, and (j) integrating the translational acceleration to compute translational velocity $V_{pe}$ of the dancer roll.

85. A method as in claim 77, including computing a target velocity command $V^*_p$ using the first and second sensed velocities and the web tension after the dancer roll.

* * * * *